US011056755B2

(12) United States Patent
Rhodes et al.

(10) Patent No.: US 11,056,755 B2
(45) Date of Patent: Jul. 6, 2021

(54) MICROWAVE RESONATOR

(71) Applicant: ISOTEK MICROWAVE LIMITED, Leeds (GB)

(72) Inventors: John David Rhodes, Menston (GB); David Ibbetson, Oxenhope (GB); Vanessa Walker, Leeds (GB); Christopher Ian Mobbs, Harrogate (GB)

(73) Assignee: ISOTEK MICROWAVE LIMITED, Yorkshire (GB)

( * ) Notice: Subject to any disclaimer, the term of this patent is extended or adjusted under 35 U.S.C. 154(b) by 0 days.

(21) Appl. No.: 16/485,665

(22) PCT Filed: Feb. 13, 2018

(86) PCT No.: PCT/GB2018/050388
§ 371 (c)(1),
(2) Date: Aug. 13, 2019

(87) PCT Pub. No.: WO2018/150170
PCT Pub. Date: Aug. 23, 2018

(65) Prior Publication Data

US 2020/0052360 A1 Feb. 13, 2020

(30) Foreign Application Priority Data

Feb. 15, 2017 (GB) ..... 1702449
Sep. 20, 2017 (GB) ..... 1715171

(51) Int. Cl.
*H01P 1/208* (2006.01)
*H01P 5/02* (2006.01)
(Continued)

(52) U.S. Cl.
CPC ..... *H01P 1/2086* (2013.01); *H01P 5/02* (2013.01); *H01P 7/06* (2013.01); *H01P 7/105* (2013.01)

(58) Field of Classification Search
CPC .. H01P 1/2086; H01P 5/12; H01P 7/06; H01P 7/105
(Continued)

(56) References Cited

U.S. PATENT DOCUMENTS 5,495,216 A 2/1996 Jachowski
2016/0322688 A1 11/2016 Weiss

FOREIGN PATENT DOCUMENTS

EP 0736923 A1 * 10/1996 ..... H01P 1/20
EP 0742603 A1 11/1996
(Continued)

OTHER PUBLICATIONS

UK Intellectual Property Office Search Report issued in UK Application No. GB1702449.8 dated Jul. 27, 2017.
(Continued)

*Primary Examiner* — Robert J Pascal
*Assistant Examiner* — Kimberly E Glenn
(74) *Attorney, Agent, or Firm* — Quinn IP Law

(57) ABSTRACT

A microwave resonator comprising a hollow tube comprising a plurality of electrically conductive wall faces which together define a tube wall defining a tube bore, the tube extending along a length axis from a first end to a second end; the tube wall having an N fold rotational symmetry about the length axis where 2<N<10; a first electrically conductive covering plate covering the first end of the tube; a second electrically conductive covering plate covering the second end of the tube; a dielectric puck comprising first and second end faces and a side wall extending therebetween, the puck being dimensioned such that when in the tube bore
(Continued)

its dominant resonant mode is a doubly degenerate mode; the puck being arranged in the tube bore spaced apart from the covering plates with its end faces normal to the length axis and centered on the length axis; the puck being spaced apart from the tube wall by a plurality N of electrically conductive spacer blocks, the spacer blocks being spaced equally around the length axis and spaced apart from the covering plates; and, a symmetry breaking structure adapted to modify the coupling between the two degenerate modes and also their relative frequencies.

48 Claims, 15 Drawing Sheets

(51) Int. Cl.
*H01P 7/06* (2006.01)
*H01P 7/10* (2006.01)

(58) Field of Classification Search
USPC ..... 333/227
See application file for complete search history.

(56) References Cited

FOREIGN PATENT DOCUMENTS

| | | |
|---|---|---|
| EP | 1962370 A1 | 8/2008 |
| GB | 2296133 A | 6/1996 |

OTHER PUBLICATIONS

UK Intellectual Property Office Search Report issued in UK Application No. GB1802302.8 dated Aug. 13, 2018.
International Search Report issued in International Application No. PCT/GB2018/050388 dated Apr. 24, 2018.
Luca Pelliccia et al "Ultra-compact pseudoelliptic waveguide filters using TM dual-mode dielectric resonators", Microwave Conference Proceedings (APMC), 2011 Asia-Pacific, IEEE, Dec. 5, 2011, p. 143-146.
Tomassoni Cristiano et al "Propagating Waveguide Filters Using Dielectric Resonators", IEEE Transactions on Microwave Theory and Techniques, Plenum, USA, vol. 63, No. 12, Dec. 1, 2015, p. 4366-4375.

* cited by examiner

MICROWAVE RESONATOR

The present invention relates to a microwave resonator. More particularly, but not exclusively, the present invention relates to a microwave resonator comprising a hollow tube having a tube bore defined by an electrically conductive tube wall, the tube having covering plates covering both ends and having an N fold rotational symmetry about a length axis extending along the length of the tube, a dielectric puck arranged in the tube bore, the puck being dimensioned such that when in the tube bore its dominant resonant mode is a doubly degenerate dominant mode, the puck being spaced apart from the tube wall by a plurality N of spacer blocks, and a symmetry breaking structure adapted to modify the coupling between the two degenerate modes and their relative frequencies. In a further aspect of the invention there is provided a microwave resonator comprising a hollow tube having a tube bore defined by an electrically conductive tube wall, the tube having covering plates covering both ends and having an N fold rotational symmetry about a length axis extending along the length of the tube, a plurality of dielectric spaced apart dielectric pucks arranged in the tube, each puck being dimensioned such that when in the tube bore its dominant mode is a doubly degenerate mode, each tube being spaced apart from the tube wall by a plurality N of spacer blocks, each puck having a symmetry breaking structure associated therewith and adapted to modify the coupling between the degenerate modes of the associated puck and also their relative frequencies.

Microwave resonators are common components in microwave electronics. They are often employed as microwave filters or multiplexers or as component parts thereof. A problem with known dielectric dual mode microwave resonators is that the first spurious mode can be close in frequency to the dominant (lowest frequency) mode. This can have a negative impact on the performance of filters and multiplexers employing such resonators. It can also make the manufacture of filters and multiplexers employing such microwave resonators more complex and expensive as one must filter out the spurious modes.

The microwave resonator according to the invention seeks to overcome the problems of the prior art.

Accordingly, in a first aspect the present invention provides a microwave resonator comprising a hollow tube comprising a plurality of electrically conductive wall faces which together define a tube wall defining a tube bore, the tube extending along a length axis from a first end to a second end;

the tube wall having an N fold rotational symmetry about the length axis where $2<N<10$;

a first electrically conductive covering plate covering the first end of the tube;

a second electrically conductive covering plate covering the second end of the tube;

a dielectric puck comprising first and second end faces and a side wall extending therebetween, the puck being dimensioned such that when in the tube bore its dominant resonant mode is a doubly degenerate mode;

the puck being arranged in the tube bore spaced apart from the covering plates with its end faces normal to the length axis and centered on the length axis;

the puck being spaced apart from the tube wall by a plurality N of electrically conductive spacer blocks, the spacer blocks being spaced equally around the length axis and spaced apart from the covering plates; and, a symmetry breaking structure adapted to modify the coupling between the two degenerate modes and also their relative frequencies.

The microwave resonator according, to the invention has a first spurious mode which is higher in frequency than the doubly degenerate dominant mode. In the case where N is odd this is much higher, typically by a factor of at least 1.5.

Further, the behaviour of the microwave resonator according the invention can be adjusted to a significant extent by simply varying the coupling between the doubly degenerate modes and their resonant frequencies and/or the coupling between the puck and other components such as other pucks or input or output microwave couplers.

Further, the microwave resonator has a very high Q.

Preferably $2<N<8$, more preferably $2<N<6$, more preferably $N=3$.

Preferably the symmetry breaking structure comprises at least one, preferably a plurality of apertures extending through the puck from one end face to the other parallel to but spaced apart from the length axis.

Preferably the widths of the spacer blocks are identical;

Preferably the symmetry breaking structure comprises an excess portion of at least one spacer block such that the spacer blocks are not all of the same width.

Preferably the puck is cylindrical.

Preferably the first covering plate is a closing plate.

Preferably the microwave resonator further comprises an input microwave single mode resonator arranged between the first closing plate and puck.

Preferably the microwave single mode resonator comprises an input combline resonator, the input combline resonator comprising an electrically conductive combline iris plate arranged in the tube bore substantially normal to the length axis between the puck and first closing plate and a central resonator body arranged in the space between the corn Nine iris plate and first closing plate, the combline iris plate comprising at least one primary slot extending therethrough.

Preferably the primary slot extends in the plane of the combline iris late parallel to a wall face and spaced apart from the length axis, the primary slot being arranged proximate to a spacer block.

Preferably the input microwave single mode resonator is a resonant waveguide.

Preferably the second covering plate is a closing plate.

Preferably the microwave resonator further comprises an output microwave single mode resonator arranged between the puck and second closing plate.

Preferably the output microwave single mode resonator comprises an output combline resonator, the output combline resonator comprising an electrically conductive combline iris plate arranged in the tube bore substantially normal to the length axis between the puck and second closing plate and a central resonator body arranged in the space between the combline iris plate and second closing plate, the combline iris plate comprising at least one primary slot extending therethrough.

Preferably the primary slot in the combline iris plate of the output combline resonator extends in the plane of the combline iris plate parallel to a wall face and spaced apart from the length axis, the primary slot being arranged proximate to a spacer block.

Preferably the primary slot in the combline; iris plate of the input combline resonator is arranged proximate to a different spacer block than the primary slot in the combline iris plate, of the output combline resonator.

Preferably the output microwave single mode resonator is a resonant waveguide.

Preferably at least one, preferably both covering plates are iris plates, each iris plate having at least one coupling slot extending therethrough.

Preferably at least one coupling slot extends parallel to a wall face and spaced apart from the length axis, the coupling slot being arranged proximate to a spacer block.

Preferably at least one coupling slot extends in the plane of the iris plate normal to a wall face through the length axis.

In a further aspect of the invention there is provided a microwave resonator comprising a hollow tube comprising a plurality of electrically conductive wall faces which together define a tube wall, the tube wall defining a tube bore, the tube extending along a length axis from a first end to a second end;

the tube wall having an N fold rotational symmetry about the length axis where $2<N<10$;

a first electrically conductive covering plate covering the first end of the tube;

a second electrically conductive covering plate covering the second end of the tube;

a plurality of dielectric pucks, each puck comprising first and second end faces and a side wall extending therebetween, each puck being dimensioned such that when in the tube bore its dominant resonant mode is a doubly degenerate mode;

the pucks being arranged within the tube bore spaced apart from each other and the covering plates, each puck being arranged with its end faces normal to the length axis and centered on the length axis, the puck adjacent to the first covering plate being the input puck;

each puck being spaced apart from the tube wall by a plurality N of electrically conductive spacer blocks, the spacer blocks being, spaced equally around the length axis;

each puck being separated from the adjacent puck in the tube bore by a coupling gap, each coupling gap having an electrically conductive iris plate arranged therein, each iris plate having at least one coupling slot extending therethrough;

the spacer blocks being spaced apart from the covering and iris plates;

each puck having a symmetry breaking structure associated therewith, each symmetry breaking structure being adapted to modify the coupling between the two degenerate modes of its associated puck and also their relative frequencies.

Preferably $2<N<8$, more preferably $2<N<6$, more preferably $N=3$.

Preferably the symmetry breaking structure associated with at least one puck comprises at least one, preferably a plurality of apertures extending through the puck from one end face to the other parallel to but spaced apart from the length axis.

Preferably the widths of the spacer blocks associated with that puck are identical.

Preferably the symmetry breaking structure associated with at least one puck comprises an excess portion of at least one spacer block separating that puck from the tube wall such that the spacer blocks separating that puck from the tube wall are not all of the same width.

Preferably at least one iris plate in a coupling gap comprises a coupling slot which extends in the plane of the iris plate parallel to a wall face and spaced apart from the length axis, the coupling slot being arranged between a spacer block of the puck on one side of the iris plate and a spacer block of the puck on the other side of the iris plate.

Preferably at least one iris plate in a coupling gap comprises a plurality, preferably N, coupling slots, each coupling slot extending in the plane of the iris plate parallel to a side face and spaced apart from the length axis, each coupling slot being arranged between a spacer block of the puck on one side of the iris plate and a spacer block of the puck on the other side of the iris plate.

Preferably at least one iris plate in a coupling gap comprises a coupling slot which extends in the plane of the iris plate normal to one of the side faces, the coupling slot passing through the length axis.

Preferably each puck is cylindrical.

Preferably the pucks are all of the same thickness from one end face to the other.

Preferably the first covering plate is a closing plate.

Preferably the microwave resonator further comprises an input microwave single mode resonator arranged between the first closing plate and input puck.

Preferably the input microwave single mode resonator comprises an input combline resonator, the input combline resonator comprising, an electrically conductive combline iris plate arranged in the tube bore substantially normal to the length axis between the input puck and first closing plate and a central resonator body arranged in the space between the combline iris plate and the first closing plate, the combline iris plate comprising at least one primary slot extending therethrough.

Preferably the primary slot in the combline iris plate extends in the plane of the combline iris plate parallel to a wall face and spaced, apart from the length axis, the primary slot being arranged proximate to a spacer block supporting the input puck.

Preferably the combline iris plate further comprises a secondary slot extending therethrough and inclined to the primary slot in the plane of the combline iris plate.

Preferably the second covering plate is a closing plate and the puck adjacent to the second closing plate is the output puck.

Preferably the input microwave single mode resonator comprises a resonant waveguide.

Preferably the microwave resonator further comprises an output microwave single mode resonator between the second closing plate and output puck.

Preferably the output microwave single mode resonator comprises an output combline resonator, the output combline resonator comprising an electrically conductive combline iris plate arranged in the tube bore substantially normal to the length axis between the output puck and the second closing plate and a central resonator body arranged in the space between the combline iris plate and the second closing plate, the combline iris plate comprising at least one primary slot extending therethrough.

Preferably the primary slot in the combline iris plate of the output combline resonator extends in the plane of the combline iris plate parallel to a wall face and spaced apart from the length axis, the primary slot being arranged proximate to a spacer block supporting the output puck.

Preferably the primary slot in the combline iris plate of the input combline resonator is parallel to the primary slot in the combline iris plate of the output combline resonator.

Preferably the output microwave single mode resonator comprises a resonant waveguide.

Preferably at least one of the covering plates, preferably both covering plates are iris plates, each iris plate comprising at least one coupling slot extending therethrough.

Preferably at least one coupling slot extends in the plane of the iris plate parallel to a wall face and spaced apart from the length axis, the coupling slot being arranged proximate to a spacer block.

Preferably at least one coupling slot extends in the plane of the iris plate normal to a wall face through the length axis.

The present invention will now be described by way of example only and not in any limitative sense with reference to the accompanying drawings in which FIG. 1 shows a microwave resonator according to the invention in cut away perspective view;

Figure 10A:
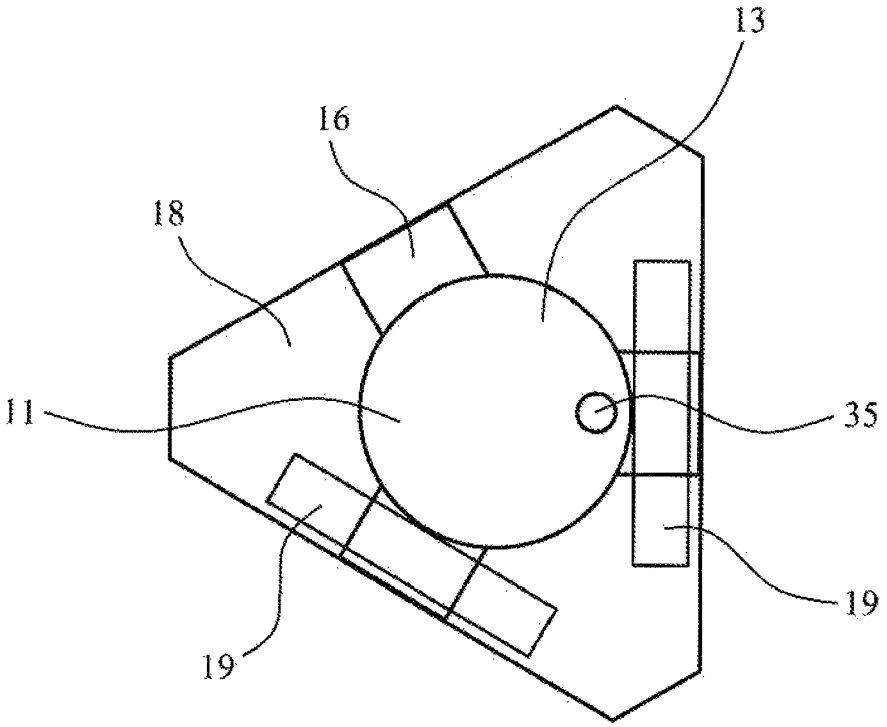
Figure 10B:
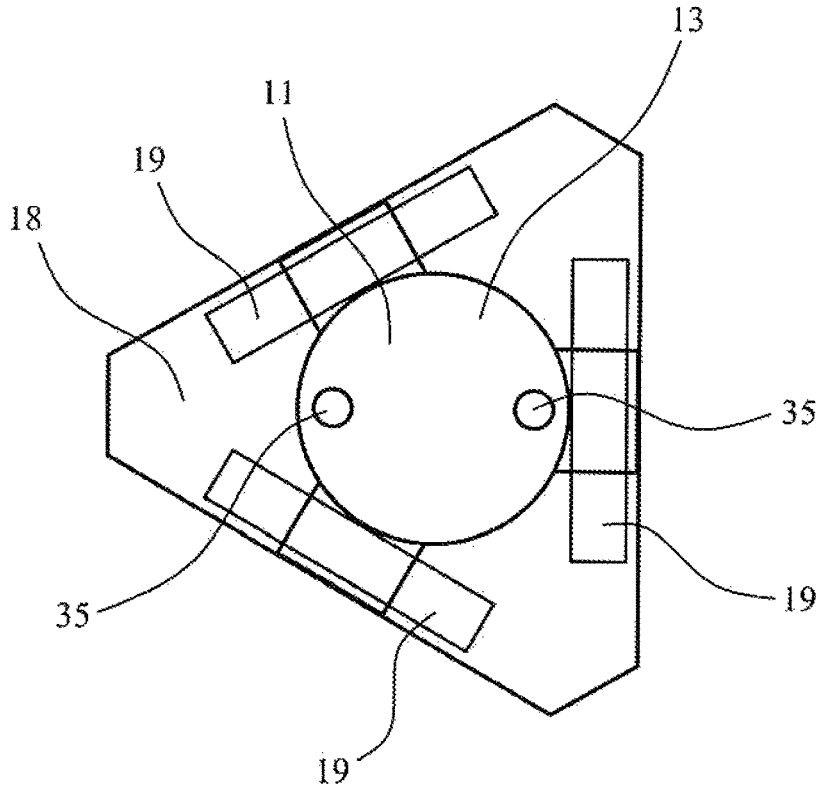
Figure 11:
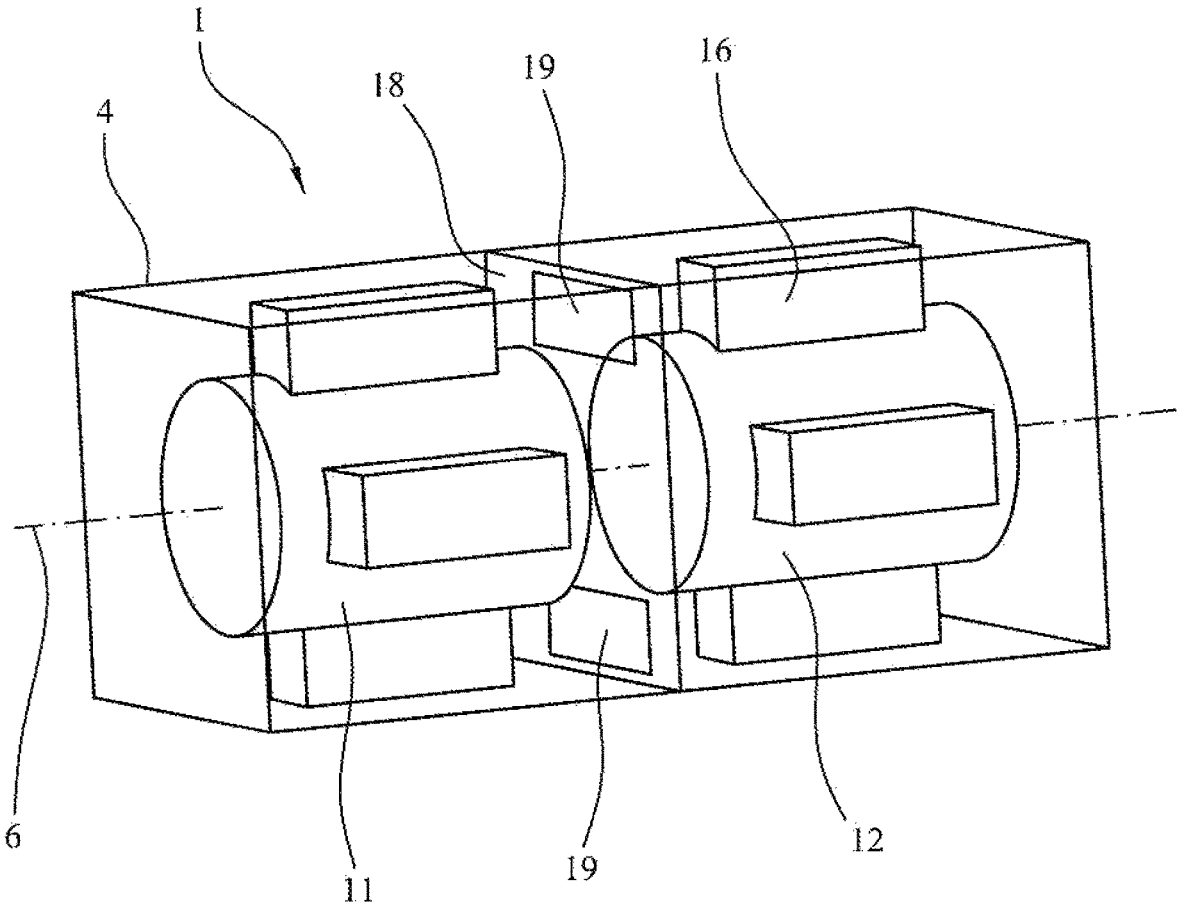
Figure 12A:
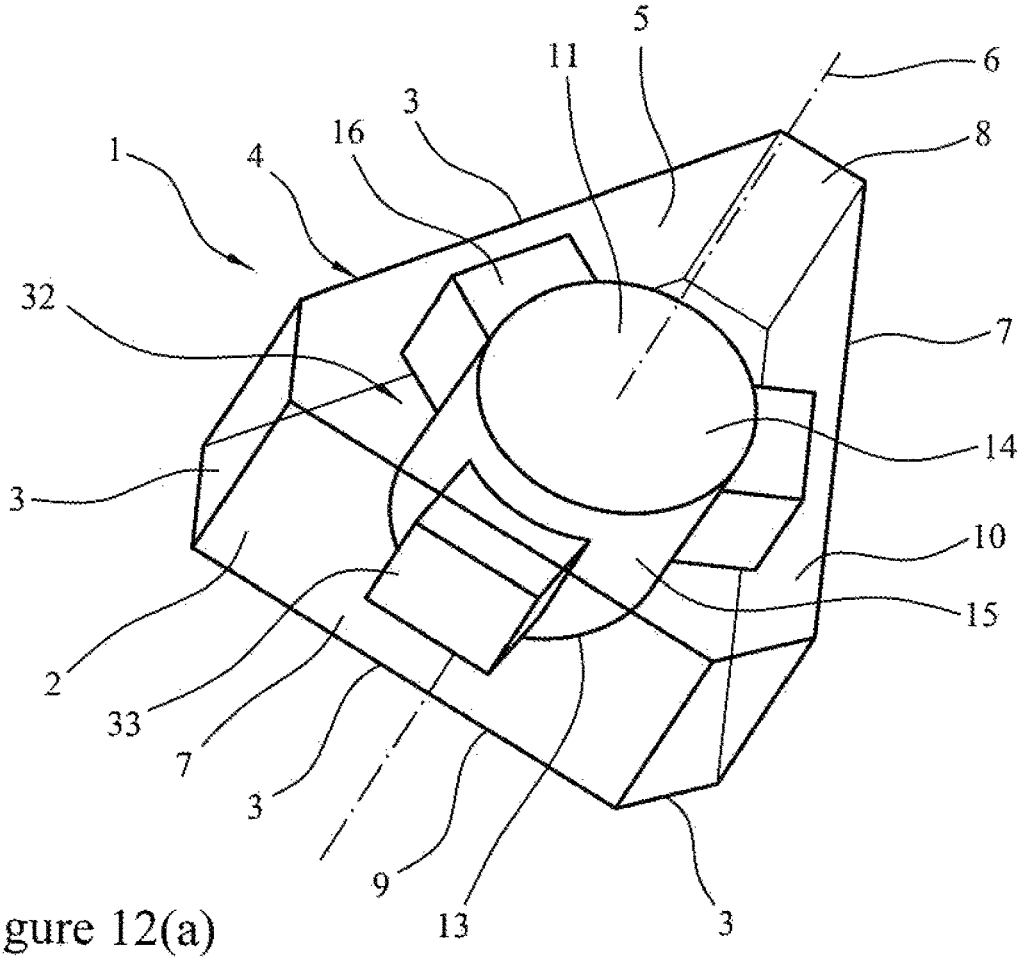
Figure 12B:
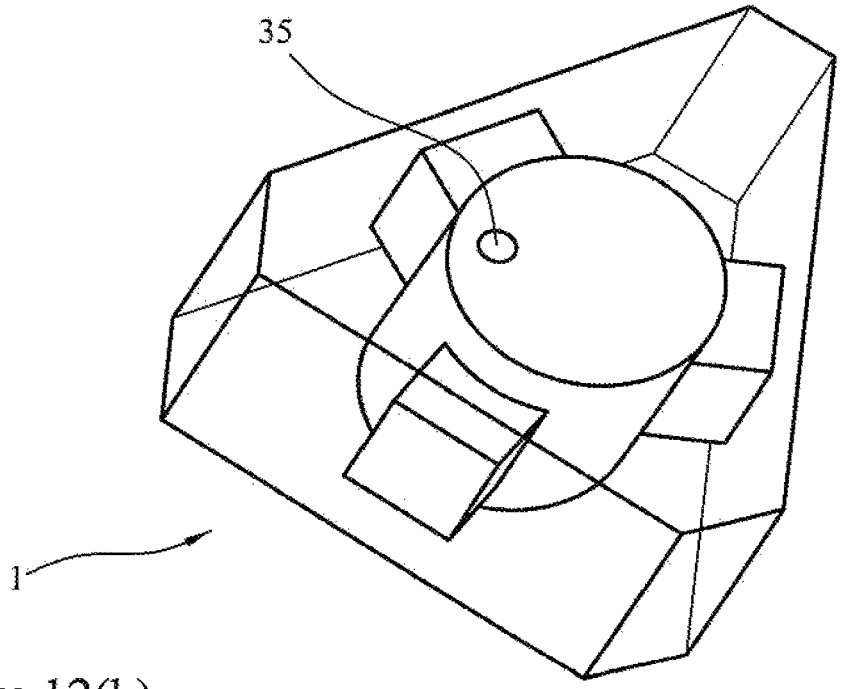
Figure 12C:
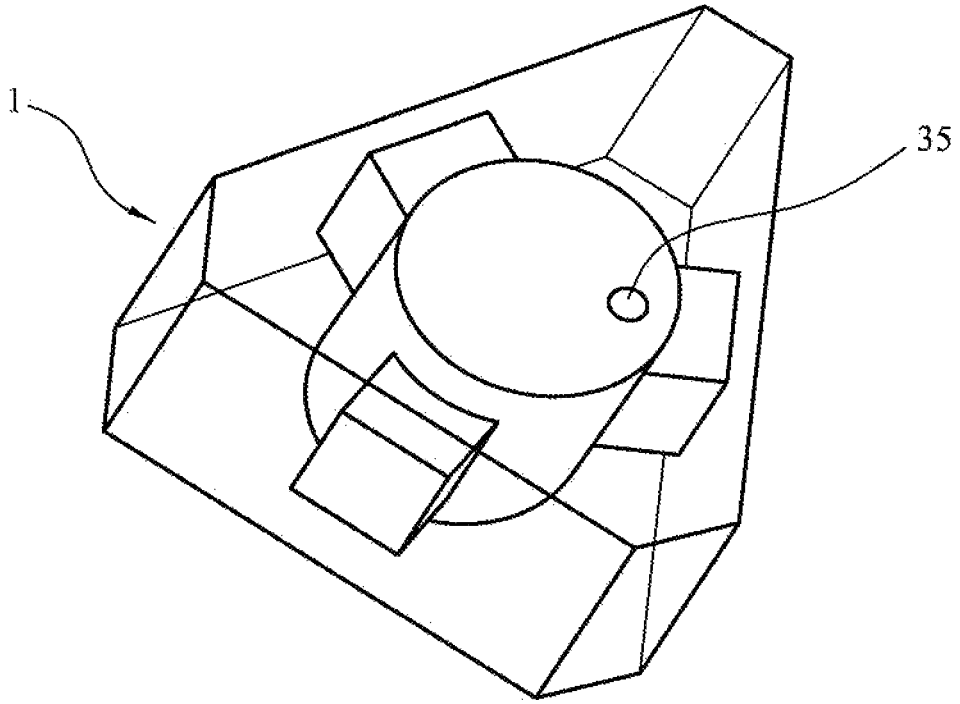
Figure 12D:
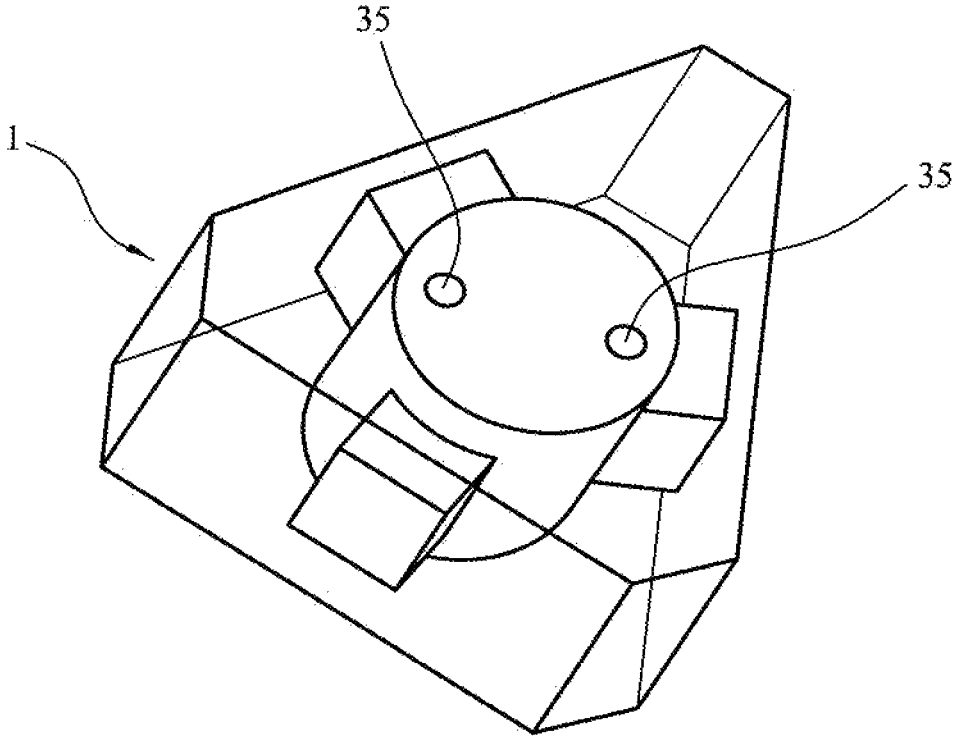
Figure 13:
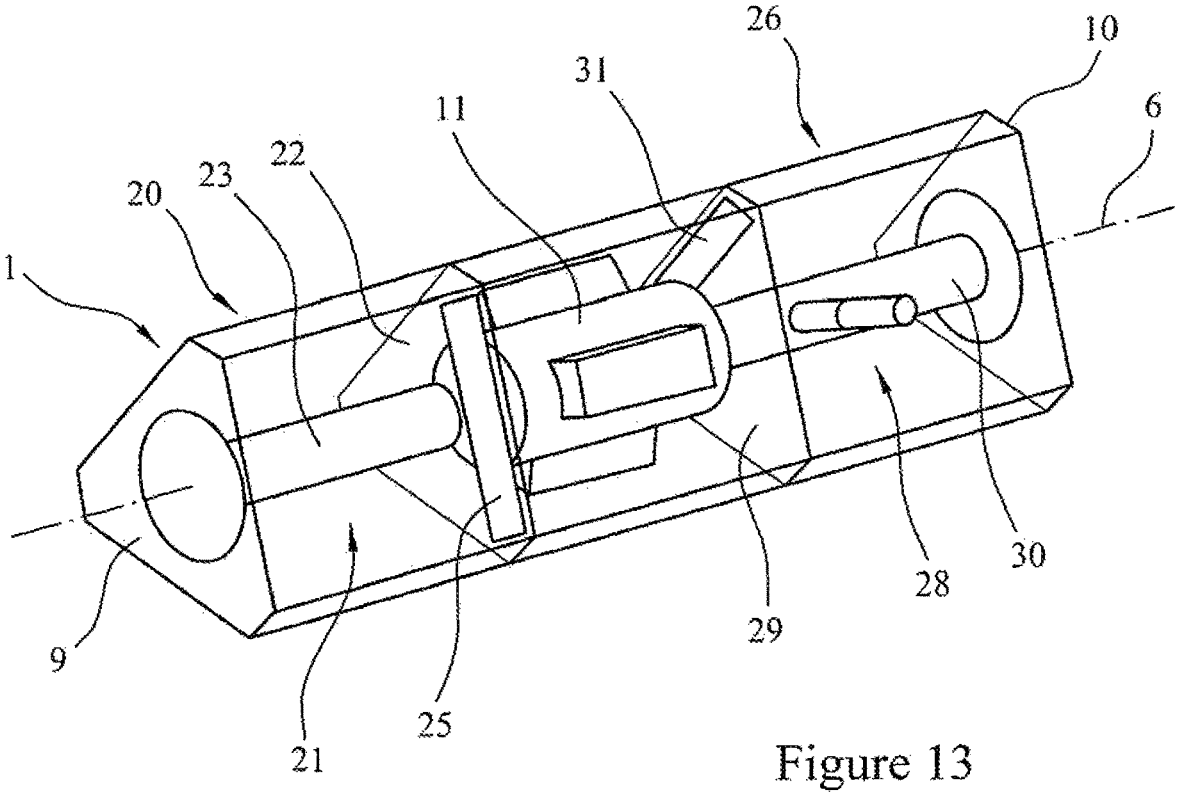
Figure 16:
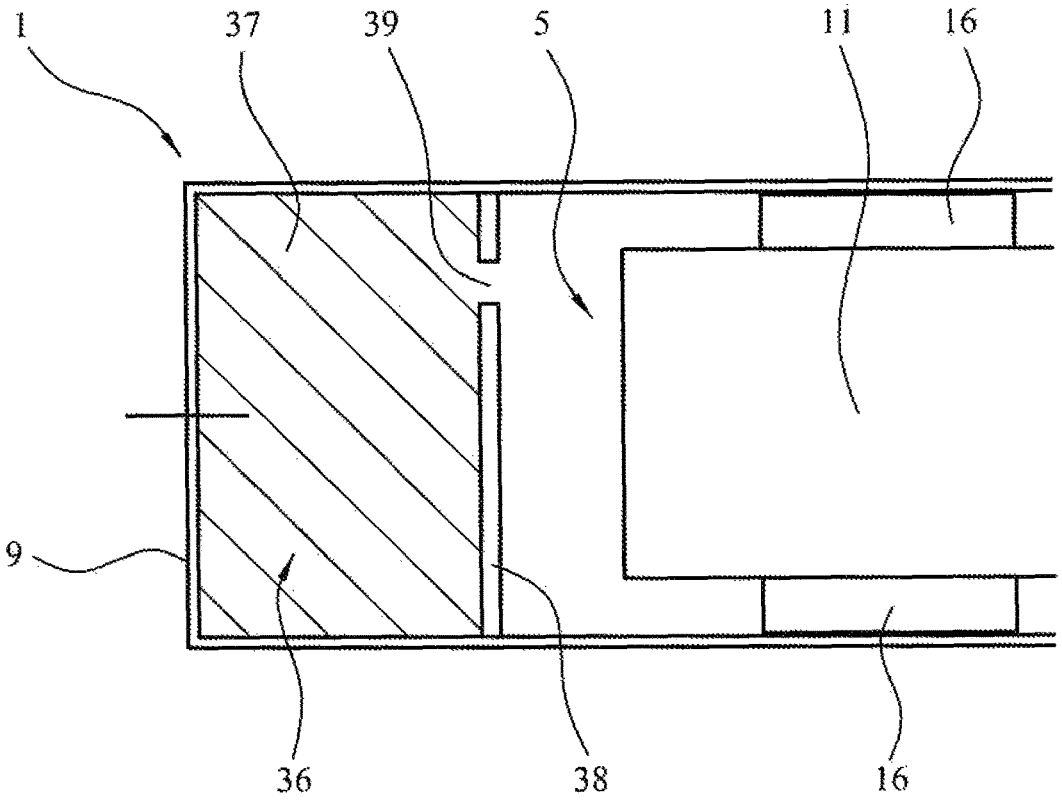
Figure 14:
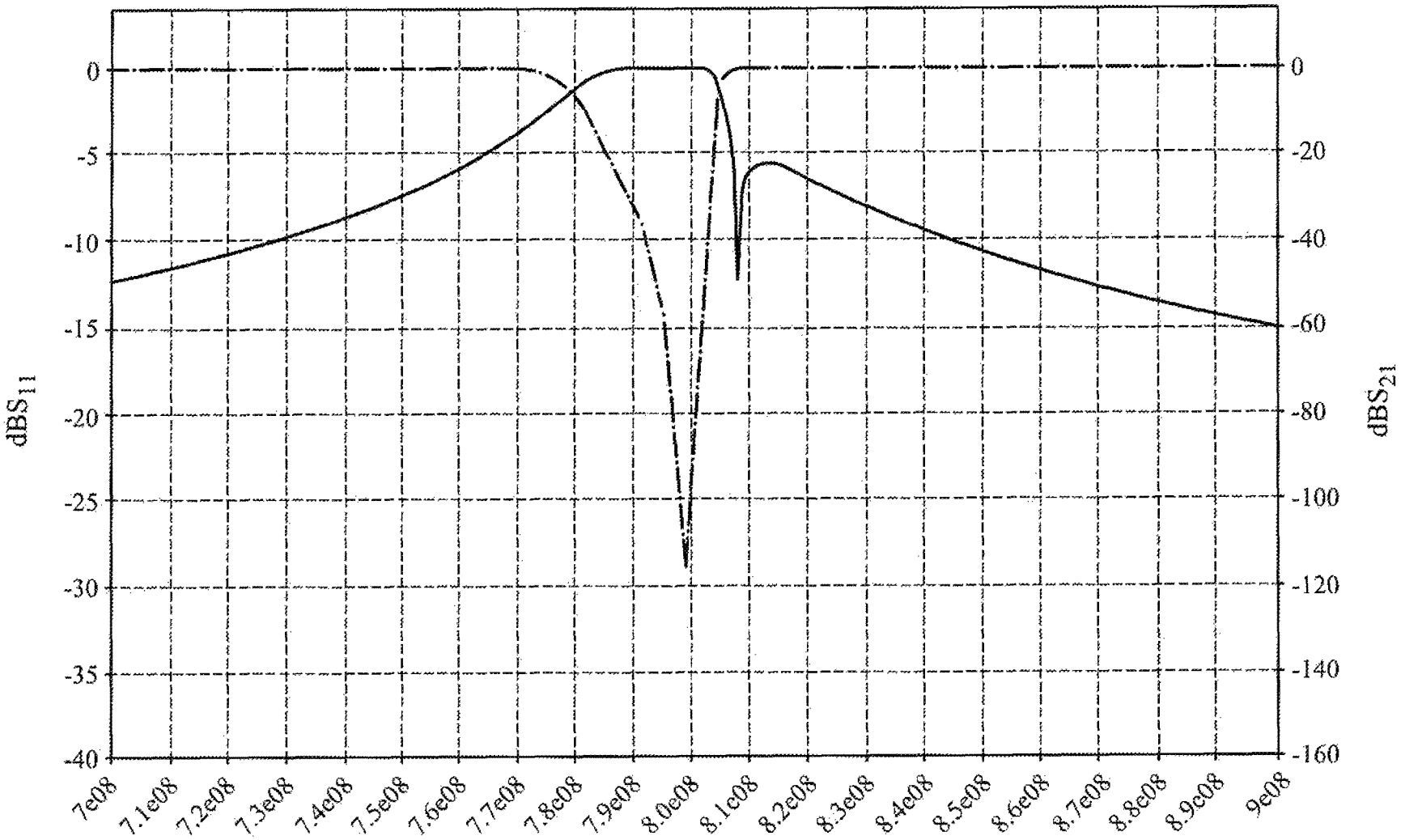
Figure 15A:
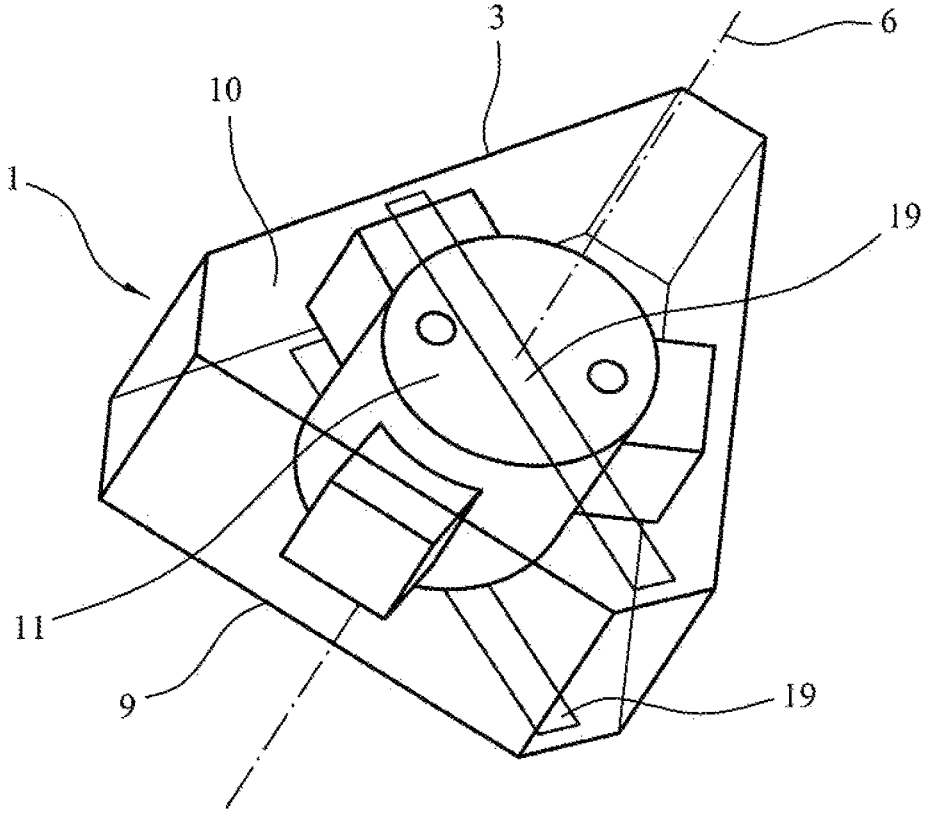
Figure 15B:
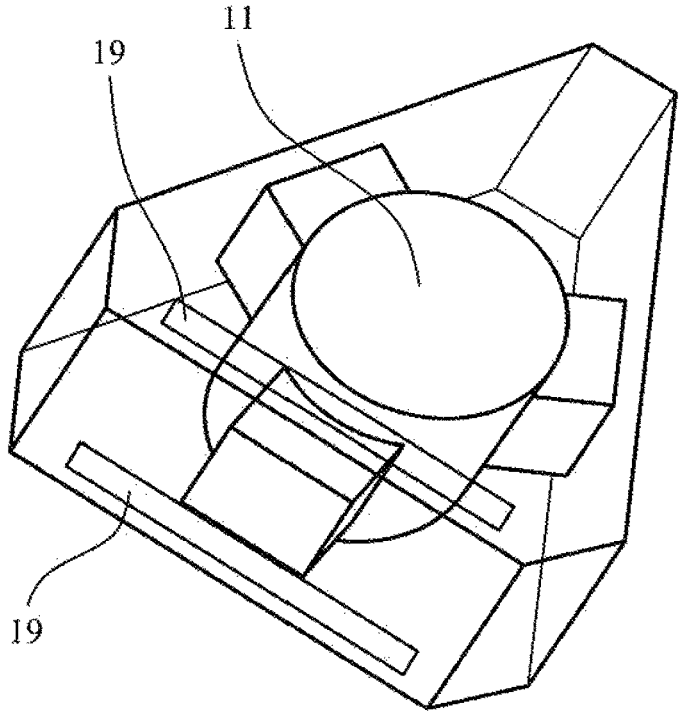
Figure 15C:
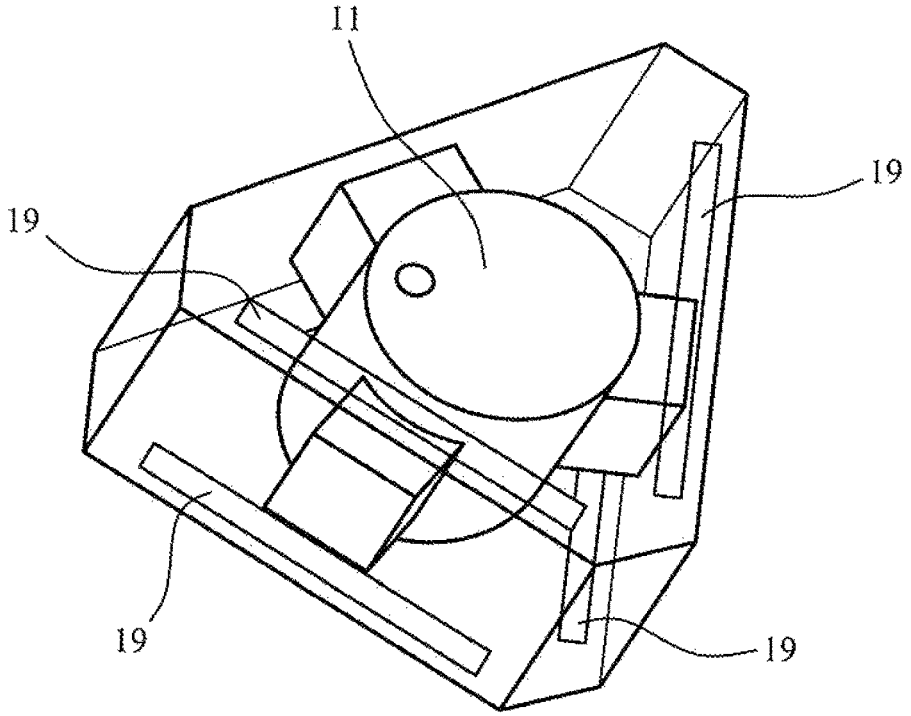
Figure 15D:
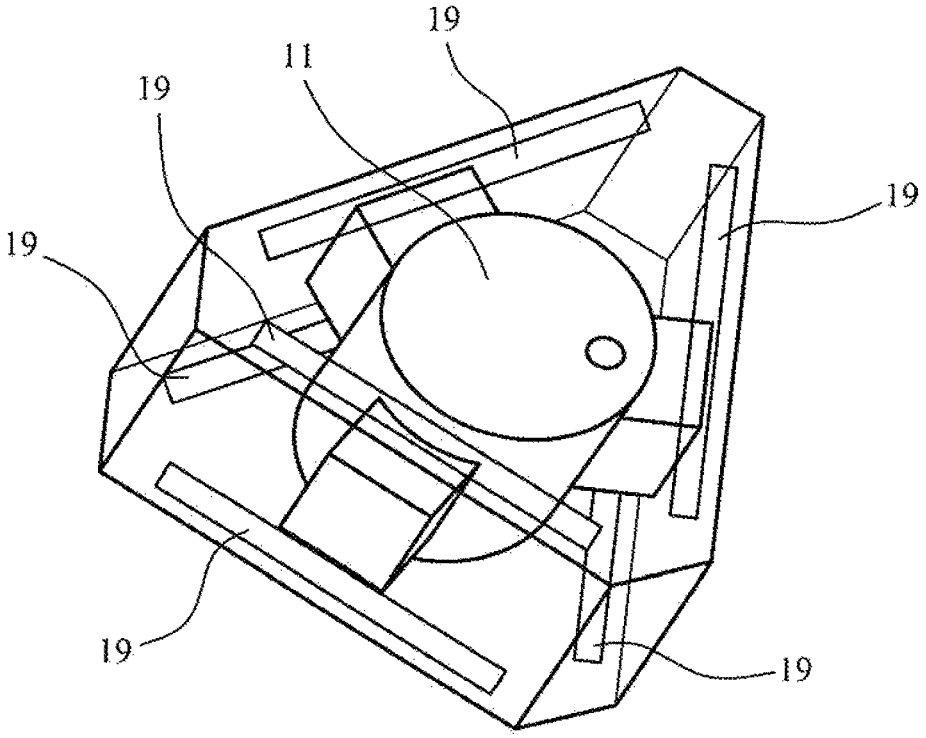

FIGS. 10(*a*) and 10(*b*) show iris plates of a microwave resonator according to the invention in plan view;

FIG. 11 shows a further embodiment of a microwave resonator according to the invention;

FIGS. 12(*a*) to 12(*d*) show further embodiments of a microwave resonator according to the invention;

FIG. 13 shows a further embodiment of a microwave resonator according to the invention;

FIG. 14 shows the behaviour of the microwave resonator of FIG. 13;

FIGS. 15(*a*) to 15(*d*) show further embodiments of microwave resonators according to the invention; and, FIG. 16 shows an end of a further embodiment of microwave resonator according to the invention.

Figure 1:
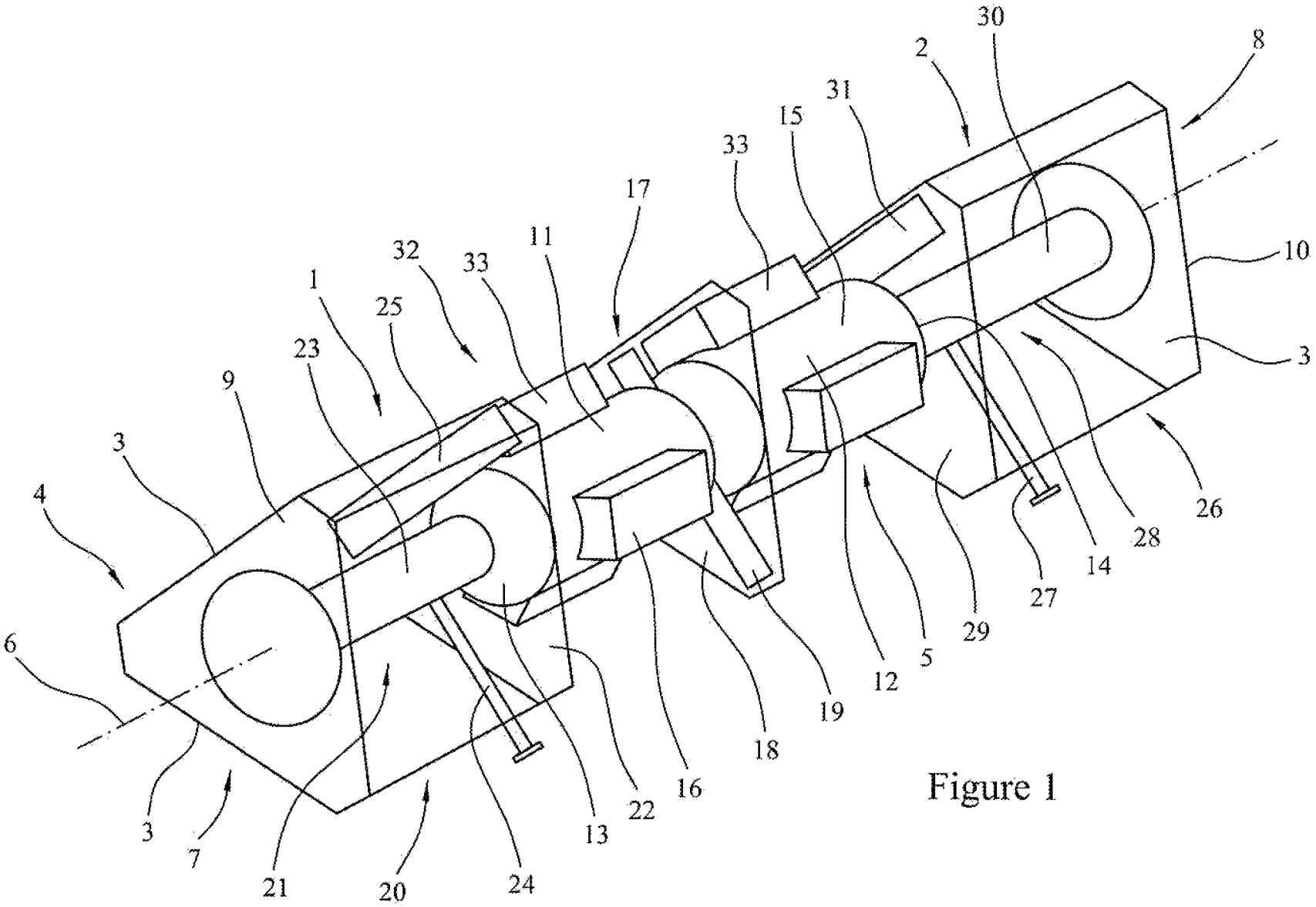

Shown in FIG. 1 is a first embodiment of a microwave resonator 1 according to the invention. The microwave resonator 1 of this embodiment is a sixth degree resonator.

The microwave resonator 1 comprises a hollow tube 2. The hollow tube 2 comprises a plurality of electrically conductive wall faces 3 which together define the tube wall 4. The tube wall 4 defines the tube bore 5. The tube 2 extends along a length axis 6 from a first end 7 to a second end 8. The tube wall 4 has an N fold rotational symmetry about the length axis 6. In this embodiment N=3. In this figure the portion of the tube wall 4 remote from the first and second ends 7,8 is not shown for clarity.

A first electrically conductive covering plate 9 covers the first end 7 of the tube 2. A second electrically conductive covering plate 10 covers the second end 8 of the tube 2. The covering plates 9,10 are closing plates 9,10 which do not have coupling slots extending therethrough. In contrast iris plates (described in more detail below) have one or more slots extending therethrough.

Arranged within the tube bore 5 are first and second dielectric pucks 11,12. Each puck 1142 comprises first and second end faces 13,14 and a side wall 15 extending therebetween. The pucks 11,12 are cylindrical having circular end faces 13,14. The pucks 11,12 are centered on the length axis 6 spaced apart from each other and the first and second closing plates 9,10. Each puck 11,12 has a length measured along the length axis 6 between the first and second end faces 13,14.

Each puck 11,12 is separated from the tube wall 4 by a plurality of electrically conductive spacer blocks 16. Typically, these extend continuously from the tube wall 4 and so may also be viewed as ridges of the tube wall 4. The spacer blocks 16 are arranged equally around the length axis 6 as shown. The number of spacer blocks 16 is equal to the degree of rotational symmetry of the tube wall 4 about the length axis 6 and accordingly in this embodiment there are three spacer blocks 16 per puck 11,12. Each spacer block 16 is centered on a wall face 3 and also on the side 15 of its associated puck 11,12 as shown. The length of each spacer block 16 measured parallel to the length axis 6 is less than the length of its associated puck 11,12 so that the puck 11,12 extends beyond the spacer blocks 16 as shown. The spacer blocks 16 are spaced apart from the covering and iris plates 2,3 (described below)

The puck 11 closest to, the first closing plate 9 is termed the input puck 11. The face of the input puck 11 closest to the first closing plate 9 is termed the input face. The puck 12 closest to the second closing plate 10 is termed the output puck 12. The face of the output puck 12 adjacent to the second closing plate 10 is termed the output face.

The dielectric of each puck 11,12 typically has a dielectric constant in the range 10 to 90, more preferably 20 to 60, more preferably 30 to 50.

The two pucks 11,12 are identical, Each puck 11,12 is dimensioned such that when arranged in the tube bore 5 its dominant resonant mode is a doubly degenerate mode, preferably the $EH_{111}$ mode. For this geometry of cylindrical pucks 11,12 in a tube bore 5 having a threefold rotational symmetry about the length axis 6 the pucks 11,12 of the microwave resonator 1 have a Q factor of around 3500 at 800 MHz. Importantly the lowest order spurious resonance is approximately a factor of around 1.6 in frequency above the fundamental doubly degenerate resonances.

The two pucks 11,12 are spaced apart by a coupling gap 17 extending therebetween. Arranged within the coupling gap 17 is an electrically conductive iris plate 18. The iris plate 18 in this embodiment is arranged equally spaced apart from the two pucks 11,12 although in alternative embodiments it may be closer to one puck 11,12 than the other. The iris plate 18 is arranged normal to the length axis 6 as shown. The iris plate 18 is the same shape as the tube bore 5 and abuts the tube bore 5 around the edge of the iris plate 18.

The iris plate 18 comprises a coupling slot 19 extending therethrough. The coupling slot 19 extends in the plane of the iris plate 18 in a direction normal to one of the wall faces 3 and through the length axis 6 as shown. The function of the iris plate 18 and the coupling slots 19 is explained in more detail below.

The microwave resonator 1 further comprises an input microwave single mode resonator 20. The input microwave single mode resonator 20 is adapted to receive an input microwave signal and provide it to the input puck 11. The input microwave single mode resonator 20 comprises an input combline resonator 21 arranged between the input puck 11 and first closing plate 9. The input combline resonator 21 comprises an electrically conductive combline iris plate 22 arranged in the tube bore 5 substantially normal to the length axis 6 between the input puck 11 and first closing plate 9. Extending from the combline iris plate 22 towards the first closing plate 9 along the length axis 6 is an electrically conductive central resonator body 23. A microwave feed line 24 extends from the central resonator body 23 out of the tube 2.

The combline iris plate 22 comprises a primary slot 25 extending therethrough. The primary slot 25 extends in the plane of the combline iris plate 22 parallel to a wall face 3 and spaced apart from the length axis 6. The primary slot 25 is arranged such that it is proximate to one of the coupling blocks 16 supporting the input puck 11 as shown.

The microwave resonator 1 further comprises an output microwave single mode resonator 26. The output microwave single mode resonator 26 receives the microwave signal from the output puck 12 and passes it to a feed line 27. The output microwave single mode resonator 26 comprises an output combline resonator 28 arranged between the output puck 12 and second closing plate 10. The output combline resonator 28 comprises an electrically conductive combline iris plate 29 arranged in, the tube bore 5 substantially normal to the length axis 6 between the output puck 12 and second closing plate 10, Extending from the combline iris plate 29 towards the second closing plate 10 along the length axis 6 is an electrically conductive central resonator body 30. The microwave feed line 27 extends from the central resonator body 30 out of the tube 2.

The combline iris plate 29 of the output combline resonator 28 comprises a primary slot 31 extending therethrough. The primary slot 31 extends in the plane of the combline iris plate 29 parallel to a wall face 3 and spaced apart from the length axis 6. The primary slot 31 is arranged such that it is proximate to one of the coupling blocks 16 supporting the output puck 12 as shown. The primary coupling slot 25 in the combline iris plate 22 of the input combline resonator 21 is parallel to the primary coupling slot 31 in the combline iris plate 29 of the output combline resonator 28.

Each puck 11, 12 further comprises a symmetry breaking structure 32 associated therewith. The symmetry breaking structure 32 modifies the frequency of one of the degenerate modes of the puck 11,12 relative to the other so that they are no longer degenerate. It also modifies the coupling between the two modes. In this embodiment the symmetry breaking structure 32 associated with each puck 11,12 comprises an excess portion 33 of one of the spacer blocks 16 supporting that puck 11,12 such that the spacer block 16 is wider than the remaining spacer blocks 16. Without this excess portion 33 the widths of the spacer blocks 16 supporting a puck 11 would be identical. The width of the spacer block 16 is measured in a plane normal to the length axis 6 and parallel to the wall face 3 abutting the spacer block 16.

In use a microwave signal is provided to the microwave feed line 24 of the input combline resonator 21, This excites the input combline resonator 21 which generates an electromagnetic field in the space between the first closing plate 9 and the combline iris plate 22 of the input combline resonator 21. This electromagnetic field couples to the degenerate modes of the input puck 11 through the primary slot 25 in the combline iris plate 22. The first degenerate mode is coupled to the second degenerate mode in the input puck 11 due to the action of the symmetry breaking structure. The second degenerate mode of the input puck 11 couples to the second degenerate mode of the output puck 12 via the coupling slot 19 in the iris plate 18 between the pucks 11,12. The second degenerate mode of the output puck 12 is coupled to the first degenerate mode due to the action of the symmetry breaking structure 31 associated with that puck 12. The first mode of the output puck 12 couples to the output combline resonator 28 via the primary slot 31 in the combline iris plate 29 of the output combline resonator 28.

Figure 2:
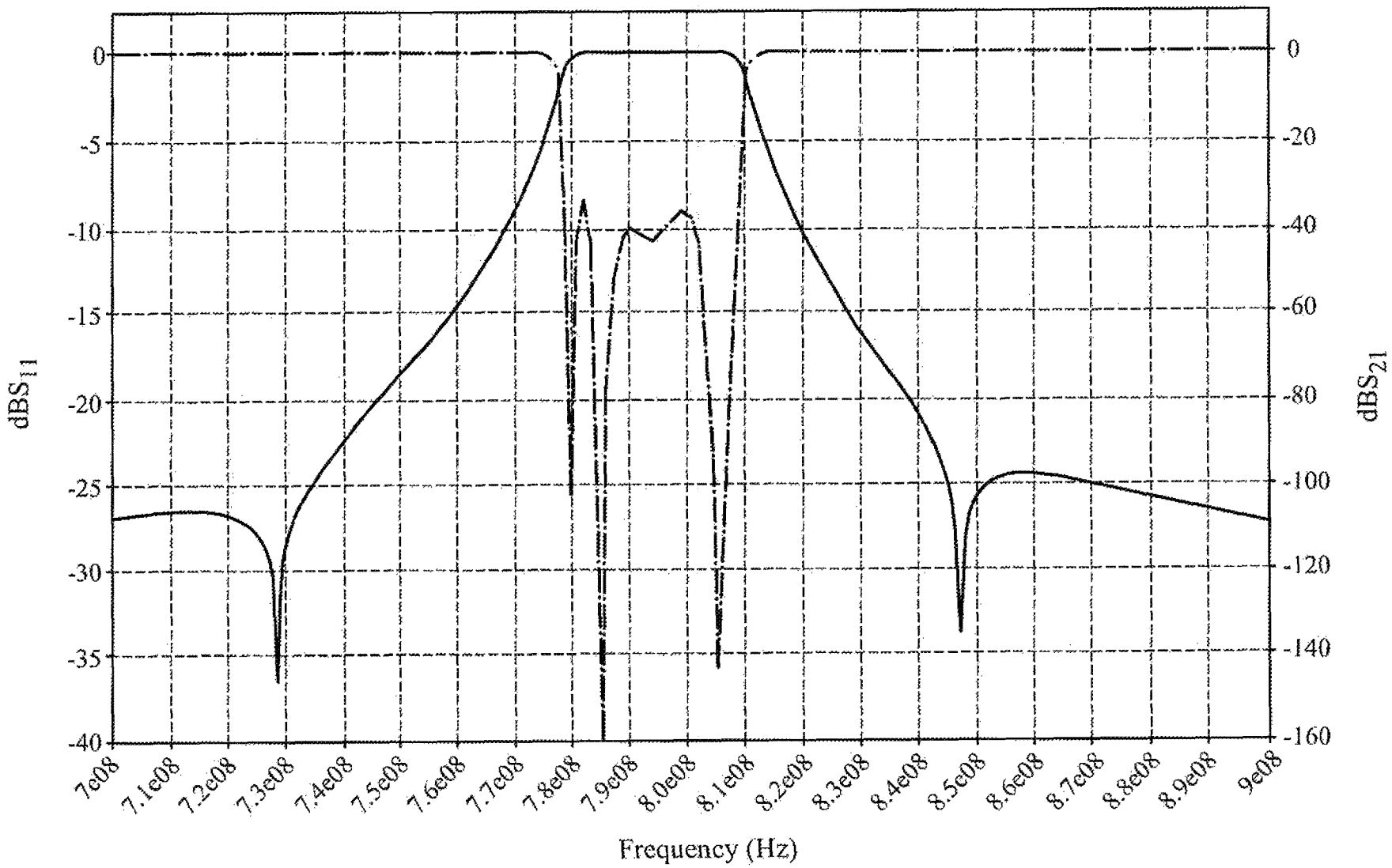
FIG. 2 shows the behaviour of the microwave resonator of FIG. 1.

The response of the microwave resonator 1 of FIG. 1 is shown in FIG. 2 showing two transmission zeros. The transmission zeros at either side of the passband are produced mainly from the weak coupling between one of the modes in each of the resonant pucks 11,12.

Figure 3:
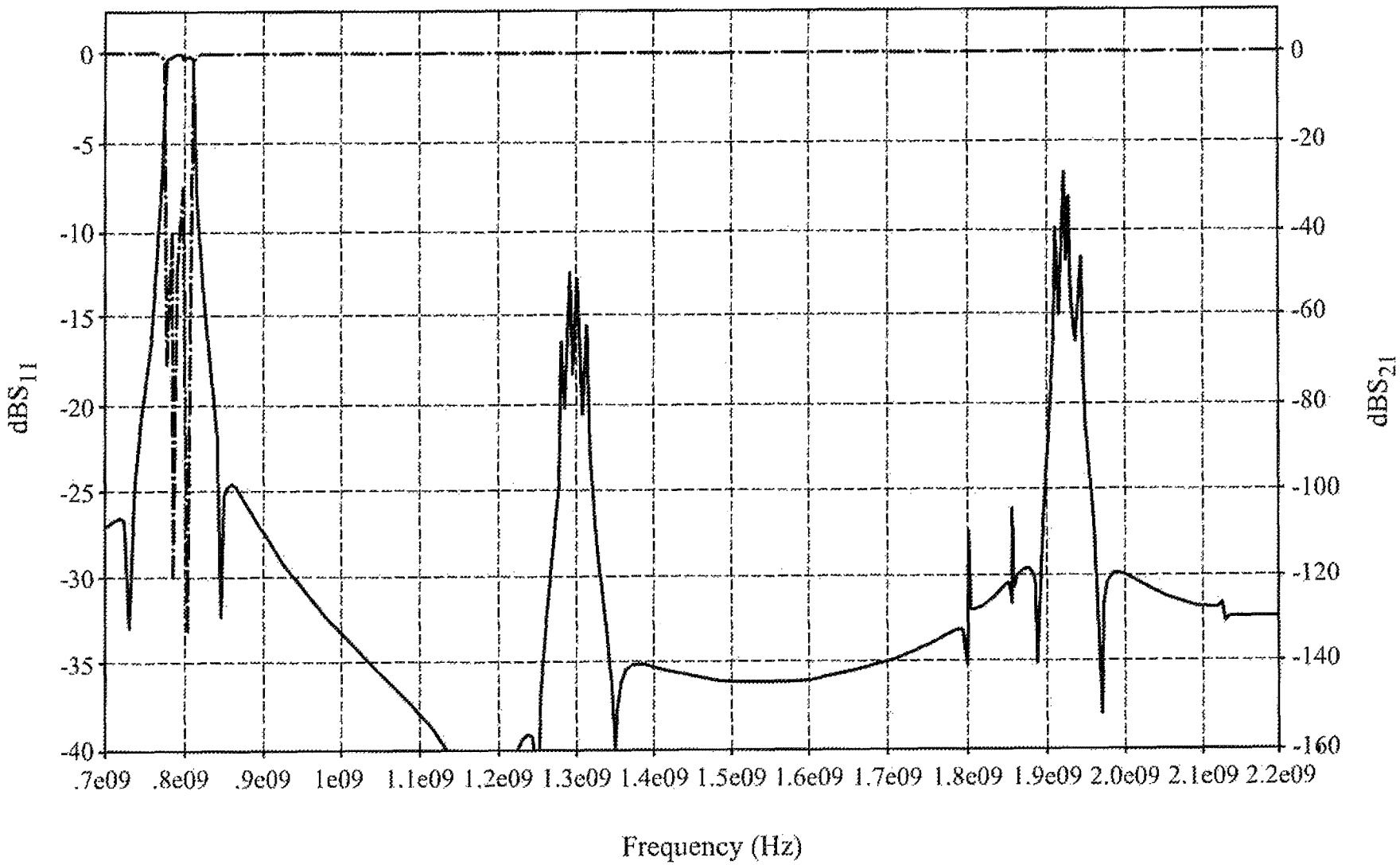
FIG. 3 shows the wide band response characteristic of the microwave resonator of FIG. 1.

Shown in FIG. 3 is the wide band response characteristic of the microwave resonator 1 of FIG. 1 with the first spurious mode being the doubly degenerate $EH_{112}$ mode with the four resonances clearly shown. The input and output combline resonators 21,28 provide attenuation to this spurious mode of 50 dB.

The operation of the microwave resonator 1 according to the invention can be explained in more detail with reference to the equivalent circuit shown in FIG. 4, Each mode in the pucks 11, 12 is represented by a node. A first mode in each of the two pucks 11,12 is $M_{11}$. The second mode in each of the two pucks 11,12 is $M_{22}$. $M_{11}$ and $M_{22}$ represent the deviation in frequency for the modes from the central frequency. The coupling between the first mode in one puck 11,12 and the first mode in the other puck 11,12 is $M_{14}$. The coupling between the second mode in one puck 11,12 and the second mode in the other puck 11,12 is $M_{23}$. The coupling between the two modes in each puck 11,12 is $M_{12}$. The coupling between the input microwave single mode resonator 20 and the two modes in, the input puck 11 (and also the coupling between the output microwave single mode resonator 26 and the two modes in the output puck 12) is $M_{01}$ and $M_{02}$ respectively. There is no coupling between a mode in one puck 11,12 and a different mode in the other puck 11,12.

Returning to FIG. 1, it is the distance between the iris plate 18 between the pucks and the pucks 1142 that determines the magnitude of the coupling between a mode in one puck 11,12 and the corresponding mode in the other puck 11,12. The strength of this coupling is modified by the area of the coupling slot(s) 19 in this iris plate 18.

The operation of the symmetry breaking structure 31 is more complex. By varying the width of one or more of the spacer blocks 16 associated with a puck 11,12 one can vary the strength of the coupling between the two degenerate modes in that puck 11,12 and also their relative frequencies.

Figure 4:
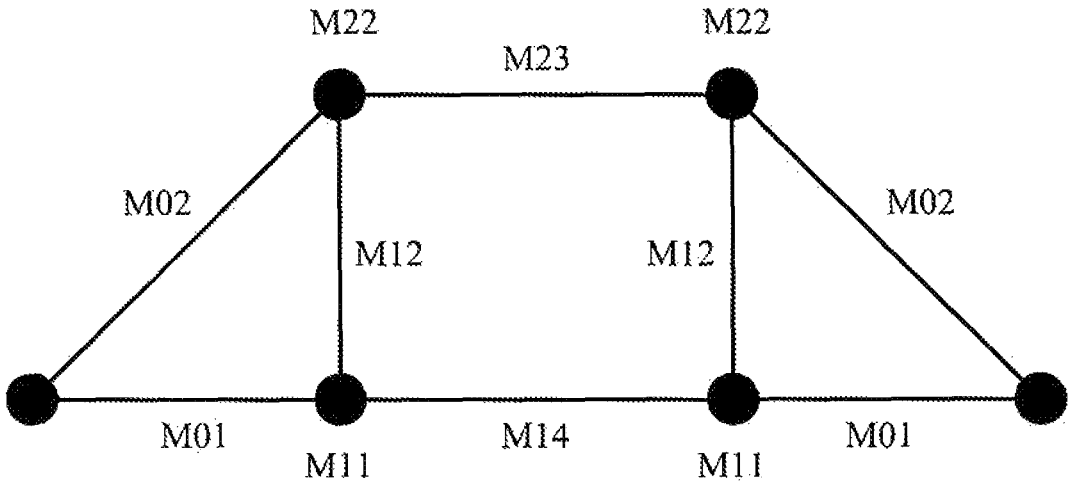
FIG. 4 shows the equivalent circuit of the microwave resonator of FIG. 1.

One can analyse the behaviour of the equivalent circuit of FIG. 4 for a given set of, couplings and resonant frequencies. These can then be adjusted to produce a microwave resonator 1 with the desired behaviour. This can then be realised as a microwave resonator 1 with the structure of FIG. 1 with the distance between the pucks 11,12 and the iris plate 18 and the positions, sizes and orientations of the slots 19,25,31 in the iris plate 18 and combline iris plates 22,29 set appropriately.

Figure 5:
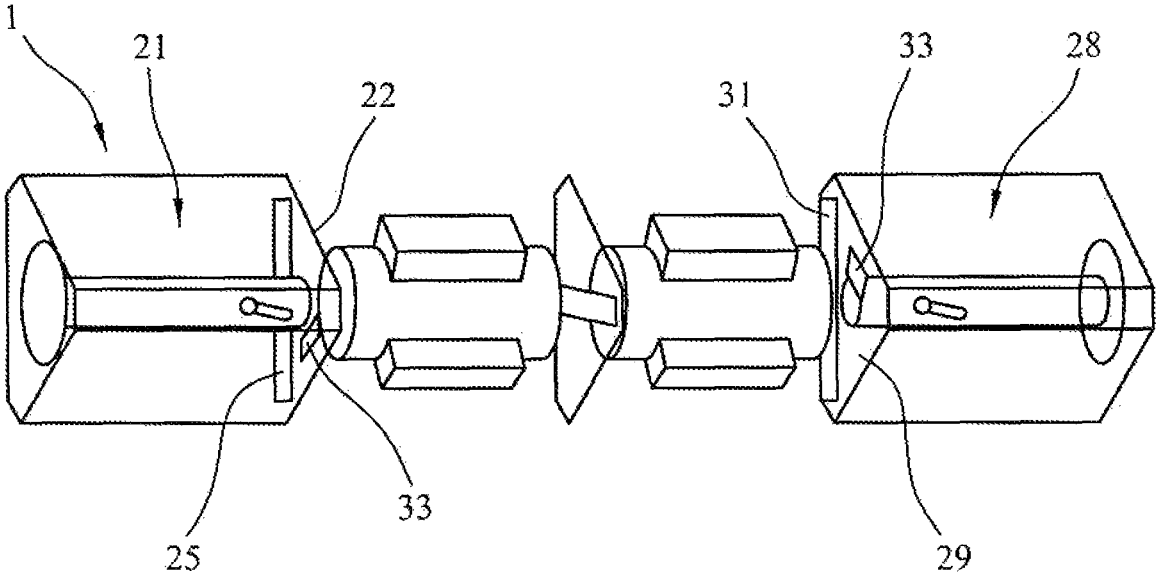
FIG. 5 shows an alternative embodiment of a microwave resonator according to the invention.

Changes to the design of the microwave resonator 1 can significantly alter its behaviour % Shown in FIG. 5 is an alternative embodiment of a microwave resonator 1 according to the invention. This is similar to that of FIG. 1 except that the combline iris plates 22,29 of the combline resonators 21,28 include smaller secondary slots 34 inclined to the primary slots 25,31. The secondary slots 34 in the combline iris plates 22,29 of the input and output combline resonators 21,28 are not parallel to each other as shown. These secondary slots 34 alter the coupling between the input and output combline resonators 21,28 and the input and output pucks 11,12. The effect of these secondary slots 34 is to enable the two transmission zeros to be moved up and down in frequency. They can be shifted to be both on the same side of the passband giving asymmetric selectivity characteristics.

Figure 6:
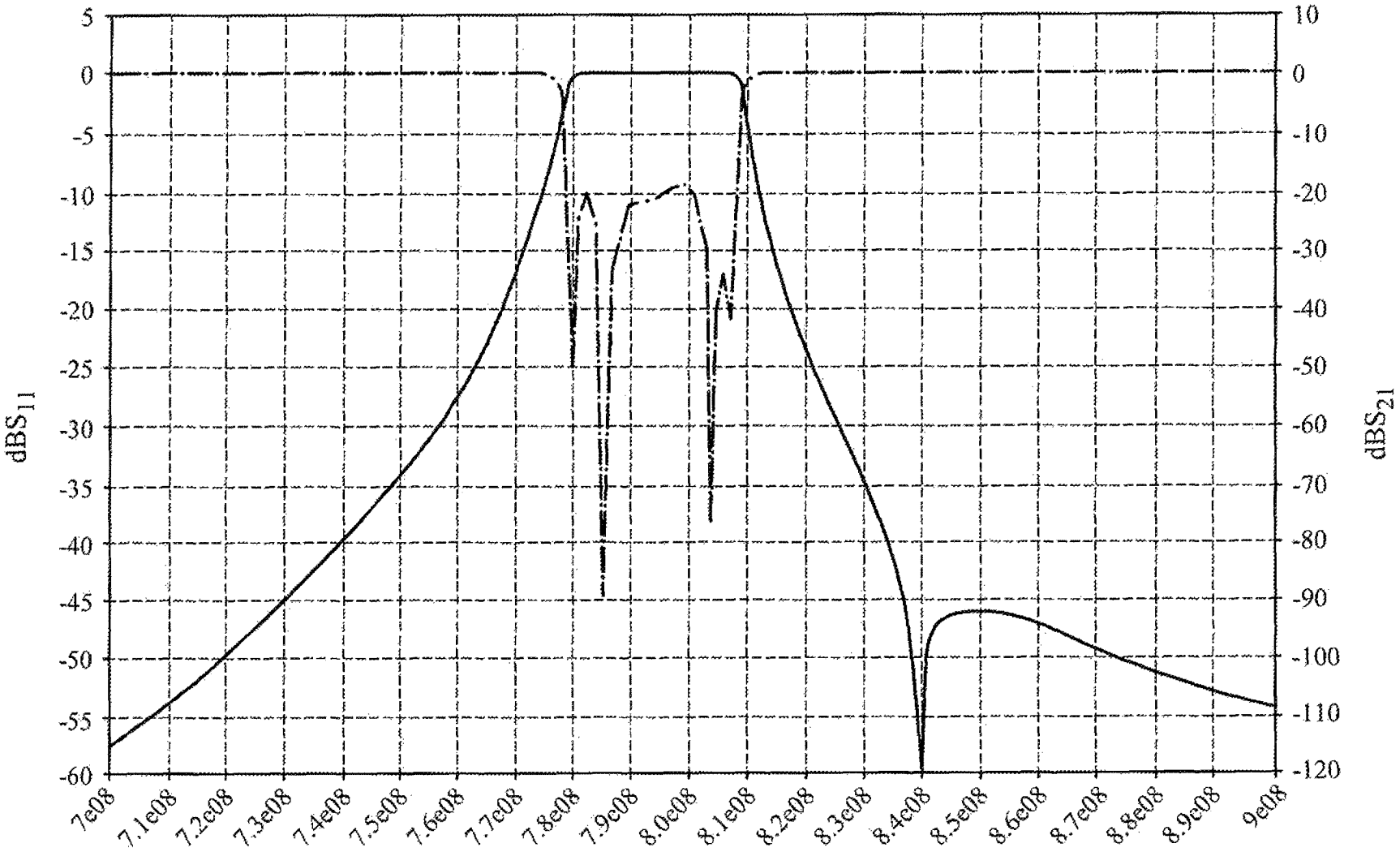
FIG. 6 shows the behaviour of the micro wave resonator of FIG. 5.

The behaviour of the microwave resonator 1 of FIG. 5 is shown in FIG. 6.

Figure 7:
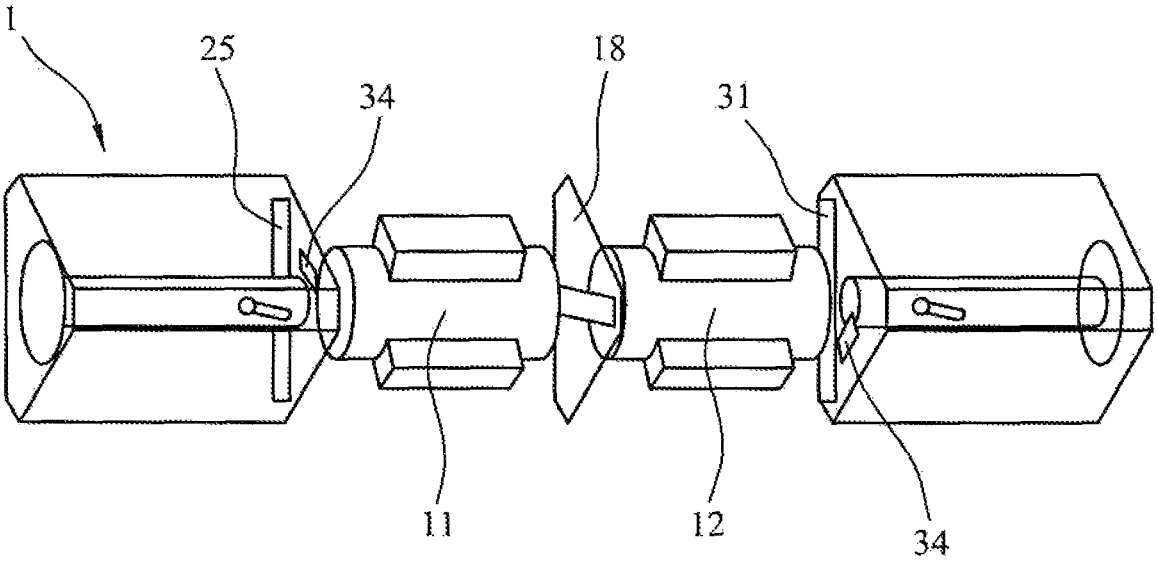
FIG. 7 shows a further embodiment of a microwave resonator according to the invention.
Figure 8:
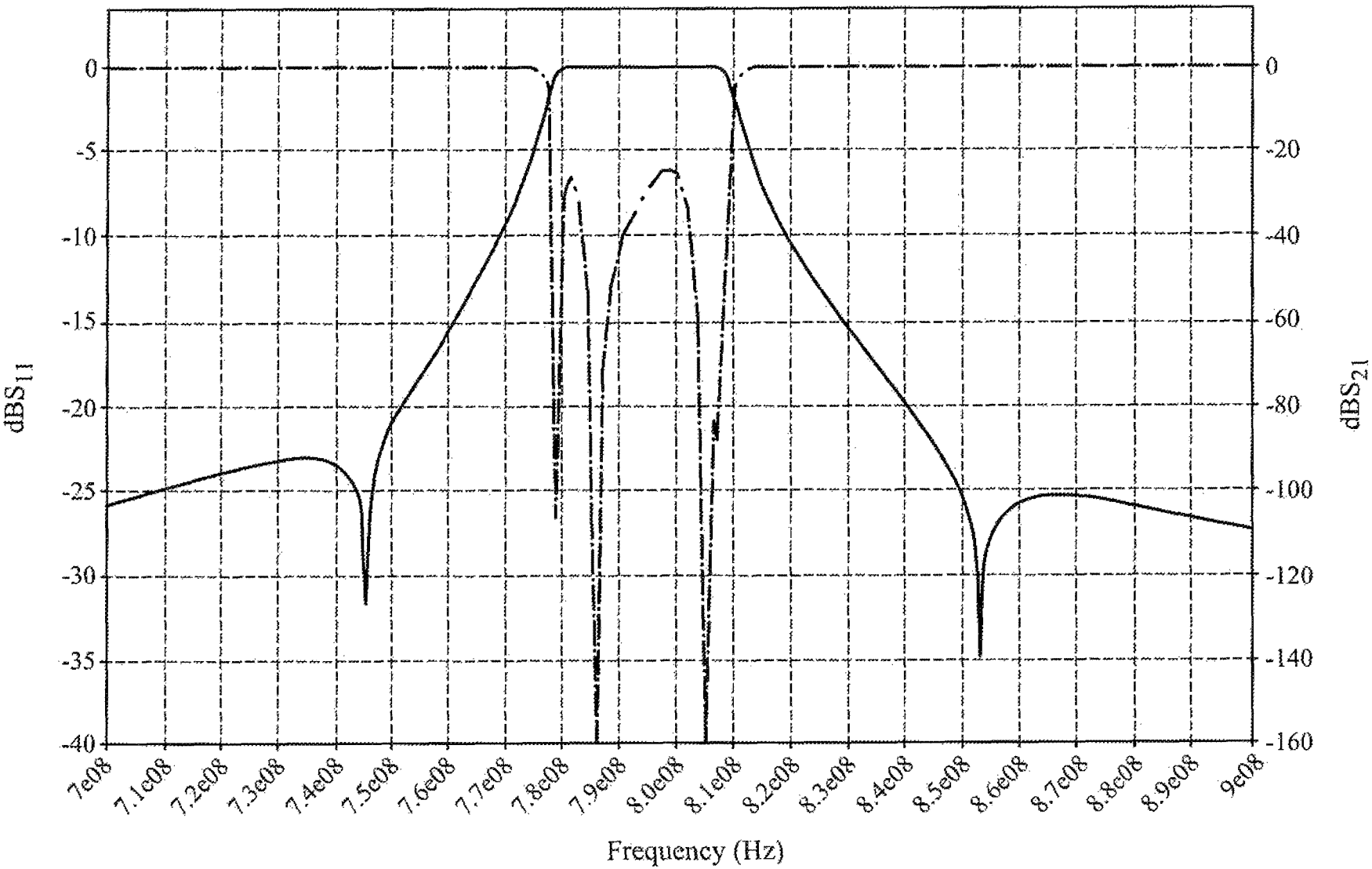
FIG. 8 shows the behaviour of the microwave resonator of FIG. 7.

Shown in FIG. 7 is a variant of the microwave resonator 1 of FIG. 5. Compared to the embodiment of FIG. 5 the secondary slots 34 in the combline iris plates 22,29 have been moved relative to the primary slots 25,31. This moves the transmission zeros as is shown in FIG. 8.

Figure 9:
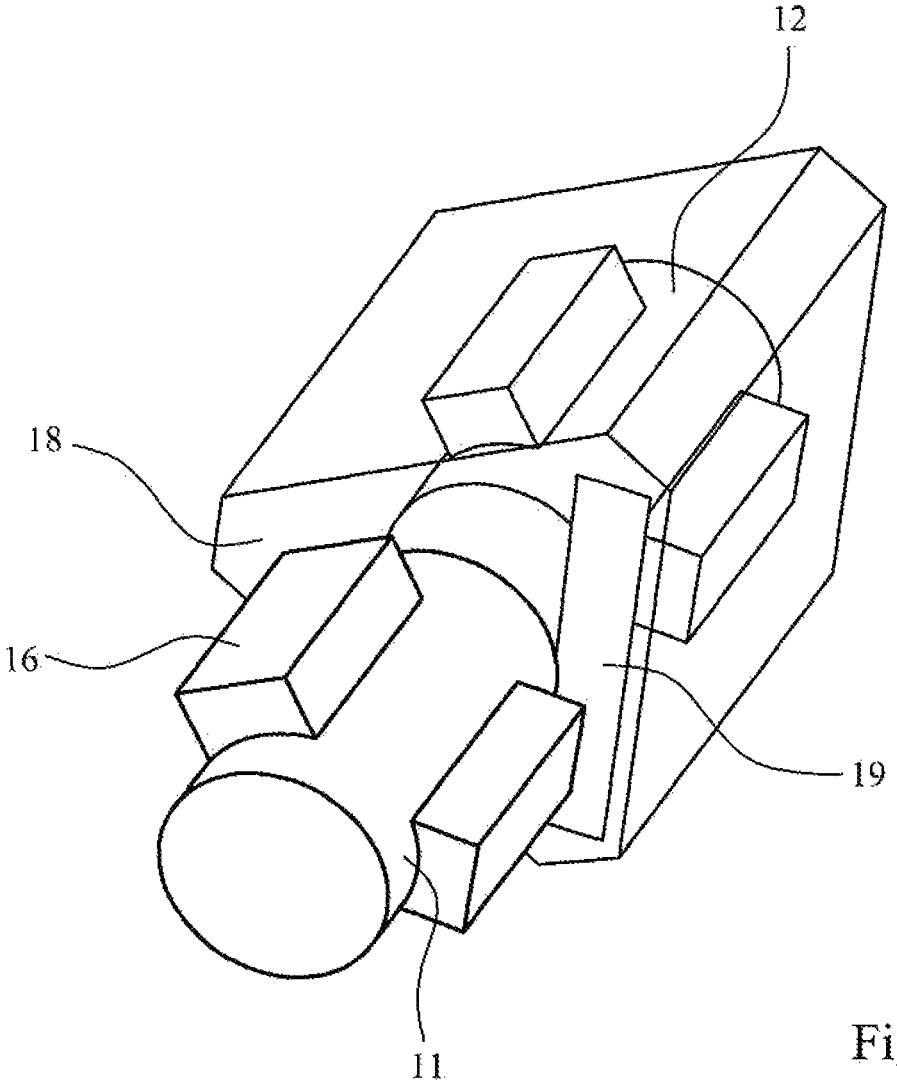
FIG. 9 shows a portion of a further embodiment of a microwave resonator according to the invention.

In all of the above embodiments the coupling slot 19 in the iris plate 18 between the pucks 11,12 extends normal to a wall face 3 through the length axis 6. Shown in FIG. 9 is a portion of a further embodiment of a microwave resonator 1 according to the invention. Only the two pucks 11,12, associated spacer blocks 16 and iris plate 18 are shown. In this embodiment the coupling slot 19 extends in the plane of the iris plate 18 parallel to a wall face 3 and is spaced apart from the length axis 6, The coupling slot 19 is arranged between a spacer block 16 of the puck 11 on one side of the iris plate 19 and a spacer block 16 of the puck 12 on the other side of the iris plate 18 as shown. This coupling slot 19 couples the first mode of one puck 11 to the first mode of the other puck 12.

Other arrangements of the coupling slots 19 in the iris plate 18 are possible. FIGS. 10(*a*) and 10(*b*) show the iris plate 18 in plan view. One of the adjacent pucks 11 and its spacer blocks 16 are also shown. In FIG. 10(*a*) the iris plate 18 comprises two coupling slots 19. Each coupling slot 19 extends in the plane of the iris plate 18 parallel to a wall face 3 and is spaced apart from the length axis 6. Each coupling slot 19 is adjacent to a spacer block 16 as shown. Each coupling slot 19 couples the first and second modes of the input puck 11 to the first and second modes of the output puck 12 respectively.

FIG. 10(*b*) shows an iris plate 18 having three coupling slots 19. Each coupling slot 19 extends in the plane of the iris plate 18 parallel to a wall face 3 as shown. Each of these slots 19 couples the first mode of the input puck 11 to the first mode of the output puck 12 and also the second mode of the input puck 11 to the second mode of the output puck 12. Other variants are possible, for example the iris plate 18 may comprise a mixture of coupling slots 19 normal to and parallel to wall faces 3.

In FIGS. 10(*a*) and 10(*b*) the widths of the spacer blocks 16 are all identical. In FIG. 10(*a*) the symmetry breaking structure 32 comprises an aperture 35 extending from one end face 13 of the puck 11 to the other end face 14 parallel to the length axis 6. By varying the diameter and position of the aperture 35 one can modify the coupling between the first and second degenerate modes of the puck 11. In FIG. 10(*b*) the symmetry breaking structure 32 comprises a plurality of apertures 35. Again, by varying the positions and sizes of these apertures 35 one can vary the coupling between the modes.

Shown in FIG. 11 is a further embodiment of a microwave resonator 1 according to the invention. Only the input and output pucks 11,12, associated spacer blocks 16, iris plate 18 and portion of the surrounding tube wall 4 are shown for clarity. The tube wall 4 has a fourfold symmetry about the length axis 6 and accordingly each puck 11,12 has four spacer blocks 16 supporting it. The spacer blocks 16 are spaced equally around the length axis 6. For a fourfold microwave resonator 1 of the same width and height as a threefold microwave resonator 1 the same Q factor is achieved. However, the first spurious resonance occurs at only 1.13 times higher frequency than the doubly degenerate fundamental mode. The figure shows how the modes are coupled together by coupling slots 19 in the iris plate 18 however the close in spurious is coupled. Further, if input and output combline filters are used then this spurious mode is coupled through making the duplexing and multiplexing of such microwave resonators 1 difficult.

In alternative embodiments of the invention the microwave resonator 1 lacks one or both of the input and output microwave single mode resonators 20,26. In this case one or both of the covering plates 9,10 are iris plates 9,10 having coupling slots 19 extending therethrough for coupling the microwave resonator 1 to other components.

In the above embodiments all of the microwave resonators 1 have only two pucks 11,12. Microwave resonators 1 having more than two pucks 11,12 are also possible.

Shown in FIG. 12(*a*) is a further example of a microwave resonator 1 according to the invention. The microwave resonator 1 comprises a hollow tube 2 comprising a plurality of electrically conductive wall faces 3 which together define a tube wall 4, The tube wall 4 defines a tube bore 5. The tube 2 extends along a length axis 6 from a first end 7 to a second end 8. The tube wall 4 has an N fold (in this case three-fold) symmetry about the length axis 6.

A first electrically conductive covering plate 9 covers the first end of the tube 2. A second electrically conductive covering plate 10 covers the second end of the tube 2. In this embodiment the covering plates 9,10 are closing plates 9,10.

A dielectric puck 11 is arranged within the tube 2. The dielectric puck 11 comprises first and second end faces 13,14 and a side wall 15 extending therebetween. In this embodiment the puck 11 is cylindrical having circular end faces 13,14. The end faces 13,14 are centered on the length axis 6 and normal thereto and the puck 11 is spaced apart from the first and second closing plates 9,10.

The puck 11 is dimensioned so that when in the tube bore 5 its dominant resonant mode is a doubly degenerate mode.

The puck 11 is spaced apart from the tube wall 4 by a plurality N (in this case three) electrically conductive spacer blocks 16. The spacer blocks 16 are spaced equally about the length axis as shown.

The microwave resonator further comprises a symmetry breaking structure 32 which modifies the frequency of one of the degenerate mode of the puck 11 relative to the other and the coupling of the two modes. The symmetry breaking structure 32 comprises an excess portion 33 of one of the spacer blocks 16 such, that it is wider than the remaining spacer blocks 16. Alternative embodiments of this microwave resonator 1 as shown in FIGS. 12(*b*) to 12(*d*). These embodiments are identical to that of FIG. 12(*a*) except that the symmetry breaking structure 32 comprises one or more apertures 35 extending from one end face 13 of the puck 11 to the other 14. In this case the spacer blocks 16 are preferably, although not necessarily ail of the same width.

Again, this embodiment of the microwave resonator 1 according to the invention has the advantage that the first spurious mode is much higher in frequency that the doubly degenerate dominant mode.

Such microwave resonators 1 are typically used with at least one of an input or output microwave single mode resonator 20,26. Shown in FIG. 13 is an alternative embodiment of a microwave resonator 1 according to the invention. This embodiment is identical to that of FIG. 12(*a*) except it includes input and output microwave single mode resonators 20,26. The input microwave single mode resonator 20 receives a microwave signal and provides it to the puck 11. The input microwave single mode resonator 20 comprises an input combline resonator 21 arranged between the puck 11 and the first closing plate 9. The input combline resonator 21 comprises an electrically conductive combline iris plate 22 arranged in the tube bore 5 substantially normal to the length axis 6 between the puck 11 and first closing plate 9. A central resonator body 23 extends from the combline iris plate 22 towards the first closing plate 9.

A primary slot 25 extends through the combline iris plate 22. The primary slot 25 extends in the plane of the combline iris plate 22 parallel to one of the wall faces 3 and spaced apart from the length axis 6. The primary slot 25 is arranged proximate to one of the spacer blocks 16 as shown.

The output microwave single mode resonator 26 receives, a microwave signal from the puck 11. The output microwave single mode resonator 26 comprises an output combline resonator 28 arranged between the puck 11 and the second closing plate 10. The output combline resonator 28 comprises an electrically conductive combline iris plate 29 arranged in the tube bore 5 substantially normal to the length axis 6 between the puck 11 and second closing plate 10. A central resonator body 30 extends from the combline iris plate 29 towards the second closing plate 10.

A primary slot 31 extends through the combline iris plate 29 of this output combline resonator 28. The primary slot 31 extends in the plane of the combline iris plate 29 parallel to one of the wall faces 3 and spaced apart from the length axis 6. The primary slot 31 is arranged proximate to one, of the spacer blocks 16 as shown. The primary slot 25 of the combline iris plate 22 of the input combline resonator 21 is arranged proximate to a different spacer block 16 than the primary slot 31 in the combline iris plate 29 of the output combline resonator 28.

In use a microwave signal excites the input combline resonator 21. This couples to both degenerate modes of the puck 11 through the primary slot 25 in the combline iris plate 22 of the input combline resonator 21, These modes in turn couple to the output combline resonator 28 through the primary slot 31 in the combline iris plate 29 of the output combline resonator 28.

As with the microwave resonators previously described this embodiment of a microwave resonator 1 has the significant advantage that the first spurious mode is much higher in frequency than the doubly degenerate dominant modes and so does not propagate through the microwave resonator 1. Further, any such spurious modes are suppressed by the input and output combline resonators 21,28.

As before, the behaviour of the microwave resonator 1 can be altered by adjusting the relative frequencies of the degenerate modes, the couplings between the first and second modes, and between the puck 11 and input and output microwave single mode resonators 20,26. The typical behaviour of the microwave resonator 1 of FIG. 13 is shown in FIG. 14. The microwave resonator 1 has a transmission zero close to the passband. This can be switched between being above the passband to below the passband by changing the sign of the coupling between the two modes.

Shown in FIGS. 15(*a*) to 15(*d*) are further embodiments of a microwave resonator 1 according to the invention. These embodiments are similar to those of FIGS. 12(*a*) to 12(*d*) except the covering plates 9,10 are iris plates 9,10. The iris plates 9,10 comprise coupling slots 19 for coupling the microwave resonator 1 to other components, for example, in filters and multiplexers, in FIG. 15(*a*) the iris plates 9,10 each comprise one coupling slot 19 which extends in the plane of the iris plates 9,10 normal to a wall face 3. In FIGS. 15(*b*) to 15(*d*) each iris plate 9,10 comprises one, two and three coupling slots 19 respectively which each extend in the plane of the iris plates 9,10 parallel to a wall face 3 and spaced apart from the length axis 6.

In all of the above embodiments the input and output microwave single mode, resonators 20,26 are combline resonators 21,28 with the resonator body 23,30 extending along the length axis 6. Other orientations of resonator bodies 23,30 are possible, for example normal to the length axis 6.

In alternative embodiments of the invention the input and output microwave single mode resonators 20,26 can take other forms. At least one of the input and output microwave single mode resonators 20,26 can be a resonant waveguide 36. Shown in FIG. 16 is one end of a microwave resonator 1 according to the invention. The resonant waveguide 36 comprises a dielectric resonant puck 37 arranged within the tube bore 5 abutting the first closing plate 9. The dielectric puck 37 terminates in an iris plate 22 having a slot 39 extending therethrough for coupling the resonant waveguide 36 to the input puck 11, Other forms of input and output single mode resonators 20,26 are possible, They could for example be electrically conductive strip lines arranged on the input and output faces of the pucks 11,12.

In the above embodiments the pucks 11,12 have been described as identical. In alternative embodiments at least one puck 11,12 may be thicker than the remaining pucks 11,12. Thickness is measured along the length axis 6 between the first and second end faces of the puck 13,14.

In the above embodiments N=3 or N=4. More generally N is in the range 3 to 9, more preferably 3 to 7, more preferably 3 to 5.

The invention claimed is:

1. A microwave resonator comprising:

a hollow tube comprising a plurality of electrically conductive wall faces which together define a tube wall defining a tube bore, the tube extending along a length axis from a first end to a second end;

the tube wall having an N fold rotational symmetry about the length axis where $2<N<10$;

a first electrically conductive covering plate covering the first end of the tube;

a second electrically conductive covering plate covering the second end of the tube;

a dielectric puck comprising first and second end faces and a side wall extending therebetween, the puck being dimensioned such that when in the tube bore a dominant resonant mode of the puck is a doubly degenerate mode;

the puck being arranged in the tube bore spaced apart from the first and second covering plates with the first and second end faces normal to the length axis and centered on the length axis;

the puck being spaced apart from the tube wall by a plurality N of electrically conductive spacer blocks, the spacer blocks being spaced equally around the length axis and spaced apart from the covering plates; and, a symmetry breaking structure adapted to modify the coupling between the two degenerate modes and also their relative frequencies.

2. A microwave resonator as claimed in claim 1 wherein $2<N<8$.

3. A microwave resonator as claimed in claim 1 wherein the symmetry breaking structure comprises at least one aperture extending through the puck from the first end face to the second end face parallel to and spaced apart from the length axis.

4. A microwave resonator as claimed in claim 3, wherein the spacer blocks are all of an identical width.

5. A microwave resonator as claimed in claim 1, wherein the symmetry breaking structure comprises an excess portion of at least one spacer block of the plurality N of electrically conductive spacer blocks such that the plurality N of electrically conductive spacer blocks are not all of the same width.

6. A microwave resonator as claimed in claim 1, wherein the puck is cylindrical.

7. A microwave resonator as claimed in claim 1, wherein the first covering plate is a first closing plate.

8. A microwave resonator as claimed in claim 7, further comprising an input microwave single mode resonator arranged between the first closing plate and the puck.

9. A microwave resonator as claimed in claim 8, wherein the microwave single mode resonator comprises an input combline resonator, the input combline resonator comprising an electrically conductive combline iris plate arranged in the tube bore substantially normal to the length axis between the puck and first closing plate and a central resonator body arranged in the space between the combline iris plate and first closing plate, the combline iris plate comprising at least one primary slot extending therethrough.

10. A microwave resonator as claimed in claim 9, where the primary slot extends in the plane of the combline iris plate parallel to a wall face of the plurality of electrically conductive wall faces and spaced apart from the length axis, the primary slot being arranged proximate to a spacer block of the plurality N of electrically conductive spacer blocks.

11. A microwave resonator as claimed in claim 9, further comprising:

an output microwave single mode resonator arranged between the puck and the second closing plate; and wherein the output microwave single mode resonator comprises an output combline resonator, the output compline resonator comprising an electrically conductive combline iris plate arranged in the tube bore substantially normal to the length axis between the puck and the second closing plate and a central resonator body arranged in the space between the combline iris plate and the second closing plate, the combline iris plate comprising at least one primary slot extending therethrough;

wherein the primary slot in the combline iris plate of the input combline resonator is arranged proximate to a different spacer block of the plurality N of electrically conductive spacer blocks than the primary slot in the combline iris plate of the output combline resonator.

12. A microwave resonator as claimed in claim 8, wherein the input microwave single mode resonator is a resonant waveguide.

13. A microwave resonator as claimed in claim 1 wherein the second covering plate is a second closing plate.

14. A microwave resonator as claimed in claim 13, further comprising an output microwave single mode resonator arranged between the puck and the second closing plate.

15. A microwave resonator as claimed in claim 14 wherein the output microwave single mode resonator comprises an output combline resonator, the output combline resonator comprising an electrically conductive combline iris plate arranged in the tube bore substantially normal to the length axis between the puck and the second closing plate and a central resonator body arranged in the space between the combline iris plate and the second closing plate, the combline iris plate comprising at least one primary slot extending therethrough.

16. A microwave resonator as claimed in claim 15, wherein the primary slot in the combline iris plate of the output combline resonator extends in the plane of the combline iris plate parallel to a wall face of the plurality of electrically conductive wall faces and spaced apart from the length axis, the primary slot being arranged proximate to a spacer block of the plurality N of electrically conductive spacer blocks.

17. A microwave resonator as claimed in claim 14 wherein the output microwave single mode resonator is a resonant waveguide.

18. A microwave resonator as claimed in claim 1, wherein at least one of the first and second covering plates are iris plates, said iris plate having at least one coupling slot extending therethrough.

19. A microwave resonator as claimed in claim 18 wherein the at least one coupling slot extends in a plane of the iris plate parallel to a wall face and spaced apart from the length axis, the coupling slot being arranged proximate to a spacer block of the plurality N of electrically conductive spacer blocks.

20. A microwave resonator as claimed in claim 18, wherein the at least one coupling slot extends in a plane of the iris plate normal to a wall face through the length axis.

21. A microwave resonator as claimed in claim 1 wherein N=3.

22. A microwave resonator comprising:

a hollow tube comprising a plurality of electrically conductive wall faces which together define a tube wall, the tube wall defining a tube bore, the tube extending along a length axis from a first end to a second end;

the tube wall having an N fold rotational symmetry about the length axis where $2<N<10$;

a first electrically conductive covering plate covering the first end of the tube;

a second electrically conductive covering plate covering the second end of the tube;

a plurality of dielectric pucks, each of the pucks comprising first and second end faces and a side wall extending therebetween, each of the pucks being dimensioned such that when in the tube bore its dominant resonant mode is a doubly degenerate mode;

the plurality of pucks being arranged within the tube bore spaced apart from each other and the covering plates, each of the pucks being arranged with its end faces normal to the length axis and centered on the length axis, the puck adjacent to the first covering plate being an input puck;

each of the pucks being spaced apart from the tube wall by a plurality N of electrically conductive spacer blocks, the spacer blocks being spaced equally around the length axis;

each of the pucks being separated from an adjacent puck of the plurality of pucks in the tube bore by a coupling gap, each coupling gap having an electrically conductive iris plate arranged therein, each of the iris plates having at least one coupling slot extending therethrough;

the spacer blocks being spaced apart from the covering and iris plates;

each of the pucks having a symmetry breaking structure associated therewith, each of the symmetry breaking structures being adapted to modify the coupling between the two degenerate modes of its associated puck and also their relative frequencies.

23. A microwave resonator as claimed in claim 22 wherein $2<N<8$.

24. A microwave resonator as claimed in claim 22 wherein the symmetry breaking structure associated with at least one puck of the plurality of pucks comprises at least one aperture extending through the at least one puck from one end face to the other parallel to and spaced apart from the length axis.

25. A microwave resonator as claimed in claim 24 wherein the spacer blocks associated with the at least one puck are identical in width.

26. A microwave resonator as claimed in claim 22 wherein the symmetry breaking structure associated with at least one puck of the plurality of pucks comprises an excess portion of at least one spacer block of the plurality N of electrically conductive spacer blocks separating the at least one puck from the tube wall such that the plurality N of electrically conductive spacer blocks separating the at least one puck from the tube wall are not all of the same width.

27. A microwave resonator as claimed in claim 22, wherein at least one iris plate in said coupling gap comprises a coupling slot which extends in the plane of the iris plate parallel to a wall face of the plurality of electrically conductive wall faces and spaced apart from the length axis, the coupling slot being arranged between a spacer block of the puck on one side of the iris plate and an other spacer block of the puck on the other side of the iris plate;

wherein the plurality N of electrically conductive spacer blocks includes the spacer block and the other spacer block.

28. A microwave resonator as claimed in claim 22, wherein at least one iris plate in said coupling gap comprises a plurality of coupling slots, each of the coupling slots extending in the plane of the iris plate parallel to a side face and spaced apart from the length axis, each of the coupling slots being arranged between a spacer block of the puck on one side of the iris plate and an other spacer block of the puck on the other side of the iris plate;

wherein the plurality N of electrically conductive spacer blocks includes the spacer block and the other spacer block.

29. A microwave resonator as claimed in claim 28 wherein at least one iris plate in said coupling gap comprises a coupling slot which extends in the plane of the iris plate normal to one of the side faces, the coupling slot passing through the length axis.

30. A microwave resonator as claimed in claim 28, wherein the plurality of coupling slots is a plurality of N coupling slots.

31. A microwave resonator as claimed in claim 22 wherein each of the pucks is cylindrical.

32. A microwave resonator as claimed in claim 22 wherein the pucks are all of the same thickness from the first end face to the second end face.

33. A microwave resonator as claimed in claim 22, wherein the first covering plate is a first closing plate.

34. A microwave resonator as claimed in claim 33 further comprising an input microwave single mode resonator arranged between the first closing plate and the input puck.

35. A microwave resonator as claimed in claim 34, wherein the input microwave single mode resonator comprises an input combline resonator, the input combline resonator comprising an electrically conductive combline iris plate arranged in the tube bore substantially normal to the length axis between the input puck and first closing plate and a central resonator body arranged in the space between the combline iris plate and the first closing plate, the combline iris plate comprising at least one primary slot extending therethrough.

36. A microwave resonator as claimed in claim 35 wherein the primary slot in the combline iris plate extends in the plane of the combline iris plate parallel to a wall face of the plurality of electrically conductive wall faces and spaced apart from the length axis, the primary slot being arranged proximate to a spacer block of the plurality N of electrically conductive spacer blocks, said spacer block supporting the input puck.

37. A microwave resonator as claimed in claim 36, wherein the combline iris plate further comprises a secondary slot extending therethrough and inclined to the primary slot in the plane of the combline iris plate.

38. A microwave resonator as claimed in claim 33 wherein the second covering plate is a second closing plate and the puck adjacent to the second closing plate is an output puck.

39. A microwave resonator as claimed in claim 38, further comprising an output microwave single mode resonator between the second closing plate and the output puck.

40. A microwave resonator as claimed in claim 39, wherein the output microwave single mode resonator comprises an output combline resonator, the output combline resonator comprising an electrically conductive combline iris plate arranged in the tube bore substantially normal to the length axis between the output puck and the second closing plate and a central resonator body arranged in the space between the combline iris plate and the second closing plate, the combline iris plate comprising at least one primary slot extending therethrough.

41. A microwave resonator as claimed in claim 40, wherein the primary slot in the combline iris plate of the output combline resonator extends in the plane of the combline iris plate parallel to a wall face of the plurality of electrically conductive wall faces and spaced apart from the length axis, the primary slot being arranged proximate to a spacer block of the plurality N of electrically conductive spacer blocks, said spacer block supporting the input puck.

42. A microwave resonator as claimed in claim 41, wherein the primary slot in the combline iris plate of the input combline resonator is parallel to the primary slot in the combline iris plate of the output combline resonator.

43. A microwave resonator as claimed in claim 40, wherein the output microwave single mode resonator comprises a resonant waveguide.

44. A microwave resonator as claimed in claim 34, wherein the input microwave single mode resonator comprises a resonant waveguide.

45. A microwave resonator as claimed in claim 22, wherein at least one of the covering plates is an iris plate, said iris plate comprising at least one coupling slot extending therethrough.

46. A microwave resonator as claimed in claim 45 wherein at least one coupling slot extends in the plane of the iris plate parallel to a wall face of the plurality of electrically conductive wall faces and spaced apart from the length axis, the coupling slot being arranged proximate to a spacer block.

47. A microwave resonator as claimed in claim 45 wherein at least one coupling slot extends in the plane of the iris plate normal to a wall face of the plurality of electrically conductive wall faces, through the length axis.

48. A microwave resonator as claimed in claim 22 wherein N=3.

* * * * *